US009181000B2

(12) United States Patent
Yoshida et al.

(10) Patent No.: US 9,181,000 B2
(45) Date of Patent: Nov. 10, 2015

(54) CONTAINER WITH CAP

(75) Inventors: Yuzo Yoshida, Tokyo (JP); Takahiro Muroi, Chiba (JP); Takahiro Takayama, Tokyo (JP); Yasuko Nakajima, Tokyo (JP)

(73) Assignee: Yoshida Industries Co., Ltd., Tokyo (JP)

( * ) Notice: Subject to any disclaimer, the term of this patent is extended or adjusted under 35 U.S.C. 154(b) by 587 days.

(21) Appl. No.: 13/509,909

(22) PCT Filed: Nov. 18, 2010

(86) PCT No.: PCT/JP2010/070538

§ 371 (c)(1),
(2), (4) Date: Jun. 13, 2012

(87) PCT Pub. No.: WO2011/062211

PCT Pub. Date: May 26, 2011

(65) Prior Publication Data

US 2012/0248129 A1 Oct. 4, 2012

(30) Foreign Application Priority Data

Nov. 20, 2009 (JP) ..... 2009-265588
Oct. 19, 2010 (JP) ..... 2010-234260
Oct. 19, 2010 (JP) ..... 2010-234261

(51) Int. Cl.
*B65D 41/16* (2006.01)
*B65D 43/02* (2006.01)
*B65D 50/04* (2006.01)

(52) U.S. Cl.
CPC ..... *B65D 41/16* (2013.01); *B65D 43/0212* (2013.01); *B65D 50/046* (2013.01);

(Continued)

(58) Field of Classification Search
CPC ..... B65D 41/16; B65D 50/45–50/46; B65D 50/48; B65D 83/40
USPC ..... 215/211, 213, 216–217, 221, 274–275, 215/330; 220/254.1, 254.7, 284–285, 315, 220/319–321; 222/498–499, 505, 509, 222/522–523, 525, 545–546, 556, 559, 562
IPC ..... B65D 41/16, 47/12
See application file for complete search history.

(56) References Cited

U.S. PATENT DOCUMENTS 3,863,814 A * 2/1975 Shelton ..... 222/153.1
4,061,239 A * 12/1977 Tasseron ..... 215/221

(Continued)

FOREIGN PATENT DOCUMENTS

JP 59-109647 7/1984
JP 59-109647 U 7/1984

(Continued)

*Primary Examiner* — Bryon Gehman
*Assistant Examiner* — Brijesh V. Patel
(74) *Attorney, Agent, or Firm* — Harness, Dickey & Pierce, P.L.C.

(57) ABSTRACT

A cap is engaged with a container at two positions, one being a fitting section between the container and an elastic ring body provided inside of the cap to be deformable from outside of the cap, the other being an engaging section between the container and engaging pieces provided on the cap. An engaging strength of the fitting section is set stronger than an engaging strength of the engaging section. The engagement at the fitting section is released when the elastic ring body is pushed from outside of the cap and deformed.

10 Claims, 25 Drawing Sheets

(52) U.S. Cl.
CPC ..... *B65D2543/0074* (2013.01); *B65D 2543/00092* (2013.01); *B65D 2543/00231* (2013.01); *B65D 2543/00296* (2013.01); *B65D 2543/00527* (2013.01); *B65D 2543/00537* (2013.01); *B65D 2543/00574* (2013.01); *B65D 2543/00629* (2013.01); *B65D 2543/00685* (2013.01); *B65D 2543/00805* (2013.01); *B65D 2543/00925* (2013.01)

(56) References Cited

U.S. PATENT DOCUMENTS

| | | | | | |
|---|---|---|---|---|---|
| 4,427,124 | A | * | 1/1984 | Marshall et al. | 215/216 |
| 4,473,162 | A | * | 9/1984 | Donoghue | 215/209 |
| 4,807,786 | A | * | 2/1989 | Gueret | 222/499 |
| 4,887,745 | A | * | 12/1989 | Gueret | 222/499 |
| 5,356,183 | A | * | 10/1994 | Cole | 285/305 |
| 5,413,233 | A | * | 5/1995 | Hall | 215/209 |
| 5,577,624 | A | * | 11/1996 | Berta et al. | 215/221 |
| 5,735,417 | A | * | 4/1998 | Darr et al. | 215/216 |
| 5,865,330 | A | * | 2/1999 | Buono | 215/216 |
| 5,941,402 | A | * | 8/1999 | Krueger | 215/209 |
| 5,979,681 | A | * | 11/1999 | PatrickJean-Luc Andre et al. | 215/216 |
| 6,168,035 | B1 | * | 1/2001 | McLelland | 215/216 |
| 6,715,646 | B2 | * | 4/2004 | Suffa | 222/153.06 |
| 2004/0067091 | A1 | * | 4/2004 | Tsutsumi | 401/127 |
| 2004/0232174 | A1 | * | 11/2004 | Hayakawa et al. | 222/556 |
| 2004/0245204 | A1 | * | 12/2004 | Suffa | 215/224 |
| 2012/0175336 | A1 | * | 7/2012 | Miller et al. | 215/216 |

FOREIGN PATENT DOCUMENTS

| | | |
|---|---|---|
| JP | 60-136940 | 9/1985 |
| JP | 60-136940 U | 9/1985 |
| JP | 04-112048 | 9/1992 |
| JP | 07-6101 | 2/1995 |

* cited by examiner

CONTAINER WITH CAP

CROSS-REFERENCE TO RELATED APPLICATIONS

This application is a 371 U.S. National Stage of International Application No. PCT/JP2010/070538, filed on Nov. 18, 2010, which claims priority to Japanese Patent Applications No. JP2009-265588, filed on Nov. 20, 2009, JP 2010-234260, filed on Oct. 19, 2010, and JP 2010-234621, filed on Oct. 19, 2010. The entire disclosures of the above applications are incorporated herein by reference.

TECHNICAL FIELD

The present invention relates to a container with a cap in which the cap can be lightly taken off from a container body with a light operating force by elastic deformation of an elastic ring body. Specifically, the invention relates to an improved technique to increase airtightness inside the container with a cap.

BACKGROUND ART

The container with the cap is structured from a container body and a cap that is attachable and detachable to and from the container body. As the container with a cap, there is one in which the cap can be lightly taken off from the container body with a light operating force by elastic deformation of the elastic ring body. With the container disclosed in Patent literature 1 shown below, the cap forms a part of an exterior of the container and comprises a cap body having a cylindrical peripheral side wall that opens downwards, when the container body is positioned upright, and a ring body fitted inside the cap body.

The cap body has an engaging protrusion projecting inwardly from the lower end thereof. The container body is also provided with an engaging projection at an outer surface thereof. When the cap is pushed in above the container body, the protrusion of the cap body and the projection of the container body come in contact, and when the cap is pushed in further, the cap itself elastically deforms, and goes over the projection of the container body. Thus, the protrusion and projection of both parts engage, and the cap is fitted to the container body.

The ring body is provided with protrusions on the outer surface thereof which project in opposite directions from each other and are exposed to the outside from holes that penetrate from the inside to the outside of the cap body. In a state where the cap is fitted to the container body, the lower end of the ring body comes in contact with the container body, and at least one of the lower end of the ring and a contacting section of the container body with the ring body is made as an inclined surface. For example, the container body has an inclined surface above the engaging projection by gradually reducing in diameter the cylindrical shape of the container body toward the upper end, which becomes an opening of the container body. When the protrusions of the ring body which are exposed to the outer side of the cap body are pressed, the ring body is urged upwardly while coming in contact with the inclined surface. As a result, the cap body rises and the engaging protrusion of the cap body go over the engaging projection of the container body, and the engagement is released. Namely, the cap can be easily taken off.

Further, while ensuring an engaging strength in which the cap and the container do not come off accidentally, the cylindrical cap body has a discal sealing section at a ceiling portion thereof to seal an opening of the container body in order to ensure the sealing performance. As a structure of the sealing section, a tubular plug that is concentric with the disk-like ceiling section is formed by hanging down from the ceiling of the cap body, and an outer diameter of the tubular plug is made to snugly fit to an inner diameter of the opening of the container. Therefore, when the cap is fitted, the outer surface of the tubular plug contacts the inner surface of the opening of the container and seals the container. Note that, in Patent Literature 1, as the sealing section, it has been proposed to construct such that a plate-shaped packing is provided and the lower surface of the packing comes in contact with the opening rim of the container body, or a structure that a protrusion is provided to fit into a central opening of the ceiling section to be adaptable to the case where a middle plug is fitted in a central hole in the opening of the container body.

CITATION LIST

Patent Literature

PTL 1: Utility Model Publication No. H7-6101

SUMMARY

Technical Problem

In the above background art, the ring body is elastically deformed with the pressing operation of the protrusions, the cap body is made to rise together with the ring body with this elastic deformation, and with this rising force the elastic plug section between the cap body and the container can come off. The fitting degree (strength) of the elastic plug section is set small to a degree that the cap body can be held on the container, so that by pressing the protrusions with a small pressing force, the cap body can come off lightly.

Therefore, the opening of the container could not be sealed in a high sealing state with the cap body. Thus, the container with the cap in the background art could not store contents that have high volatility. Further, in an environment in which the internal pressure of the container becomes higher than an outer pressure and the cap body is pressed upwards, the airtightness inside the container could not be satisfactorily maintained, and thus such container could not be used.

The present invention has been made in view of the above problems, and an object is to provide a container with a cap in which the cap can be easily taken off from the container body by a light operating force. Another object of the present invention is to provide a container which can increase airtightness inside the container body, while the cap is taken off from the container body by elastic deformation of the elastic ring body. Other objects will be made clear from the disclosure set forth below.

Solution to Problem

An aspect of the invention to achieve the above object is a container comprising a container body and a cap, the container body in an upright position having from the top to the bottom in order an upper opening, a neck section, a cone section and a body section, the cap being fitted in a detachable manner to the container body to seal the opening of the container body, wherein the cap comprises a top section, a peripheral side wall that hangs downward from a peripheral edge of the top section, an elastic ring body that is surrounded by the peripheral side wall and is elastically deformable in a radial direction, and push buttons that are formed on a peripheral surface of the elastic ring body to protrude in opposite directions to each other, wherein the cone section of the container body gradually expands from the lower end of the neck section to the upper end of the body section, and a lower inner edge of the elastic ring body comes to contact with the cone section when deformed in radial direction thereof, wherein the push buttons are formed to expose from the inside to the outside of the peripheral side wall of the cap, and when the push buttons are pressed in opposed directions, the elastic ring body is deformed to reduce the diameter thereof and the cap is moved up together with the elastic ring body, the container further comprising an engaging section and a fitting section, wherein the engaging section engages the cap with the container body in a state the cap is fitted to the container body, holds the cap and the container body in a predetermined positional relationship, and releases the engagement when the cap is made to rise from the fitted state, and wherein the fitting section engages the elastic ring body to the container body, in a state the cap is fitted to the container body, and releases the engaged state when the elastic ring body is elastically deformed, and wherein an engaging strength of the fitting section is set stronger than an engaging strength of the engaging section.

The container body can have a neck section and a body section larger in diameter than the neck section, and the corn section is formed between the neck section and the body section to gradually expand toward a lower side from the neck section to the body section. Further, the cone section is formed on the elastic ring body, and a peripheral side surface of the container body is made to contact with the cone section when the ring body is deformed.

With a container according to any of the above, the engaging section may comprise a first protrusion provided on the peripheral side surface of the neck section of the container body, and an engaging piece provided inside of the peripheral side wall of the cap and arranged to be engaged with the first protrusion, and wherein the fitting section is composed of a second protrusion provided on the peripheral side surface of the neck section of the container body, and a fitting projection provided inside of the elastic ring body to be engaged with the second protrusion.

Further, with a container according to any of the above, a length during which the fitting projection engages the protrusion is set longer than a length during which the engaging piece engages with the protrusion, or a fitting angle (θ1) between the fitting projection and the protrusion is set smaller than an engaging angle (θ2) between the engaging piece and the protrusion.

Further, with a container according to any of the above, the engaging piece can be formed in a hook-shape at a tip end of a flexible wall provided to the cap. A plurality of the engaging pieces can be provided inside the peripheral side wall of the cap with a spacing in between in a circumferential direction of the peripheral side wall. The engaging piece can be provided along an entire periphery in the circumferential direction of the inner wall surface of the peripheral side wall of the cap. The protrusion may comprise the first protrusion that engages with the engaging piece and the second protrusion that engages to the fitting projection. The push buttons can be exposed to the outside via through holes perforated in the peripheral side wall of the cap.

Further, with a container according to any of the above, the push buttons can be exposed to the outside via through holes perforated in the cylindrical peripheral wall, and in order to prevent the elastic ring body from deforming in a vertical direction when the cap section rises without pushing the push buttons, a supporting section can be provided to engage the elastic ring body with the cap body section when the cap section rises and thereby to maintain the sealing state of the opening rim of the container with the cap.

With a container including the engaging supporting section, the supporting section can be a brim piece formed on the cap to be engaged with the elastic ring body, or the supporting section can be a brim piece formed on the elastic ring body to be engaged with.

Further, this invention can be a container wherein the cap comprises a top plate covered by the top section, adapted to cover the opening rim of the container, and arranged inside of the elastic ring body;

the cylindrical peripheral wall of the cap surrounds the periphery of the elastic ring body, and includes a supporting section adapted to support a lower end surface of the elastic ring body so that the elastic ring body is always maintained horizontally;

the push buttons are exposed to the outside via one of a pair of notched sections and through holes formed facing each other in the cylindrical peripheral wall; and the top plate is formed integrally with the cylindrical peripheral wall via the supporting section.

With a container including the supporting section, the cap can be structured from two parts of a first part including the cylindrical peripheral wall having the supporting section and a second part including the top section having the elastic ring body, and these two parts are integrally assembled so that the lower end section of the elastic ring body is positioned above the supporting section. In another modification, the cap section can be structured from three parts of the cylindrical peripheral wall having the supporting section, the elastic ring body, and the top section, and the elastic ring body is integrally assembled with the cap section such that the ring body contacts the supporting section of the cylindrical peripheral wall.

Advantageous Effects of Invention

With the container with a cap of this invention, the cap can be easily taken off from the container body by a light operating force, and airtightness inside the container body can be increased, with a structure in which the cap is taken off from the container body by elastic deformation of the elastic ring body as a precondition.

DESCRIPTION OF EMBODIMENTS

First Embodiment

Structure

Figure 1:
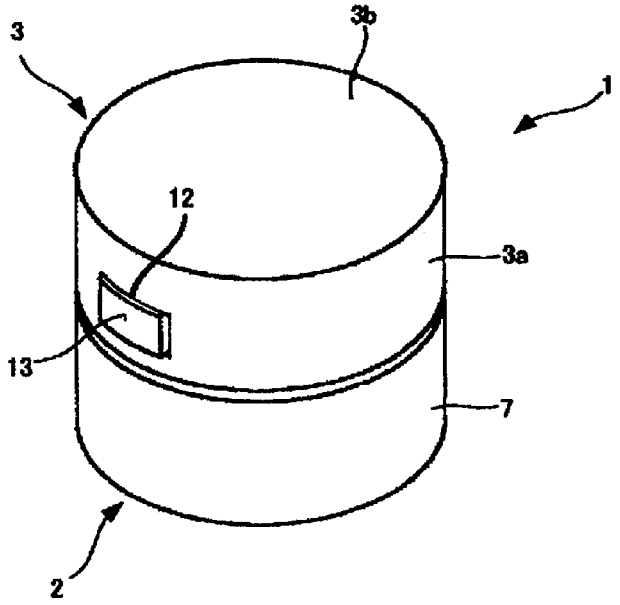
FIG. 1 is an overall perspective view showing a preferable embodiment of a container in a first embodiment of the present invention.

FIG. 1 is an external view of a container 1 positioned upright comprising a container body 2 that stores contents inside and a cap 3 that is fitted to the container body 2 from above. The cap 3 in a cylindrical shape has a top section 3*b* and a cylindrical peripheral wall 3*a* which hangs down from the periphery of the top section 3*b*. The cap 3 further includes push buttons 13 one of which is shown in FIG. 1 as exposed outside of the peripheral wall 3*a* through a hole 12 perforated in the cylindrical peripheral wall 3*a*. As to the push buttons 13, detailed explanation shall be made hereinafter.

Figure 2:
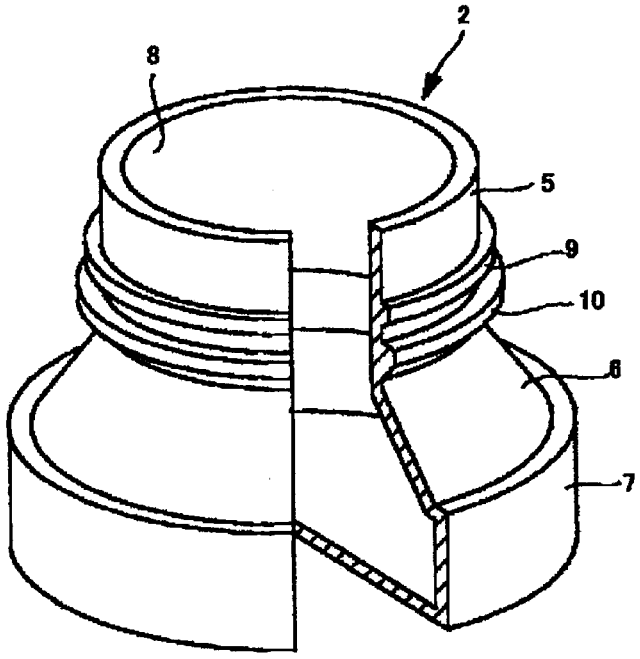
FIG. 2 is a partially cutaway perspective view showing a container body with the cap in FIG. 1.

FIG. 2 is an external view of the container body 2. The container body 2 is formed from a raw material of synthetic resin, metal or glass, in the shape of a jar as shown in the figure. The container body 2 has from the top to the bottom in order, a small diameter cylindrical neck section 5, a cone section 6 that expands downwards, and a large diameter body section 7. The top end of the neck section 5 is formed with an opening rim 8 to take out the contents. The cone section 6 forms a ring shaped slope that is inclined outwardly toward the body section 7.

A peripheral side surface of the neck section 5 of the container body 2 is provided with a first ring shaped protrusion 9 and a second ring shaped protrusion 10 which are formed integrally with the neck section 5, and here is shown an example in which first and second protrusions 9 and 10 are formed as separated up and down, respectively, and the outer diameter of the first protrusion 9 is made smaller than that of the second protrusion 10.

The structure of the cap 3 is shown in detail in FIGS. 3 to 6. The cap 3 can be separated in two parts, one of which is a cap body 3*c* and the other of which is an elastic ring body 4.

Figure 3:
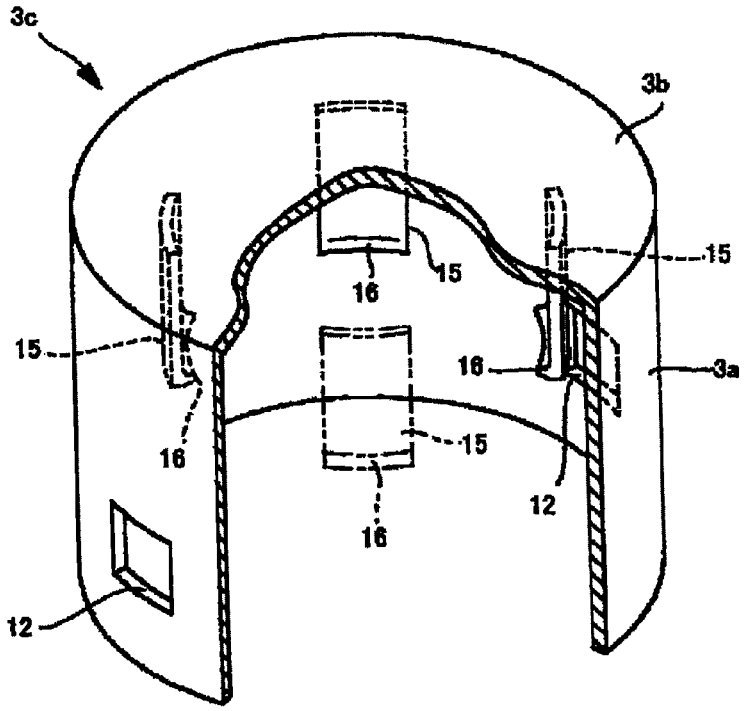
FIG. 3 is a partially cutaway perspective view of a cap body of the container in FIG. 1.

FIG. 3 is a perspective view of a cap body 3*c* in which top section 3*b* and the cylindrical peripheral wall 3*a* are partially cutaway. The cap body 3*c* is made of synthetic resin or metal. The top section 3*b* is provided integrally at the inside of the peripheral side wall 3*a* with a plurality of flexible wall pieces 15 that extend downward therefrom. Each flexible wall piece 15 is formed, primarily, to be elastically deformable in a radial direction of the top section 3*b*. Specifically, the flexible wall pieces 15 are provided with an interval therebetween in a circumferential direction of the top section 3*b* of the cap 3. The lower end of each flexible wall piece 15 is provided integrally with a first engaging section 16 in a hook-shape that engages with the ring shaped protrusion 9 at the upper side of the container body 2. Note that, four flexible wall pieces 15 are provided in the embodiment shown, but two or more can be provided.

Figure 4:
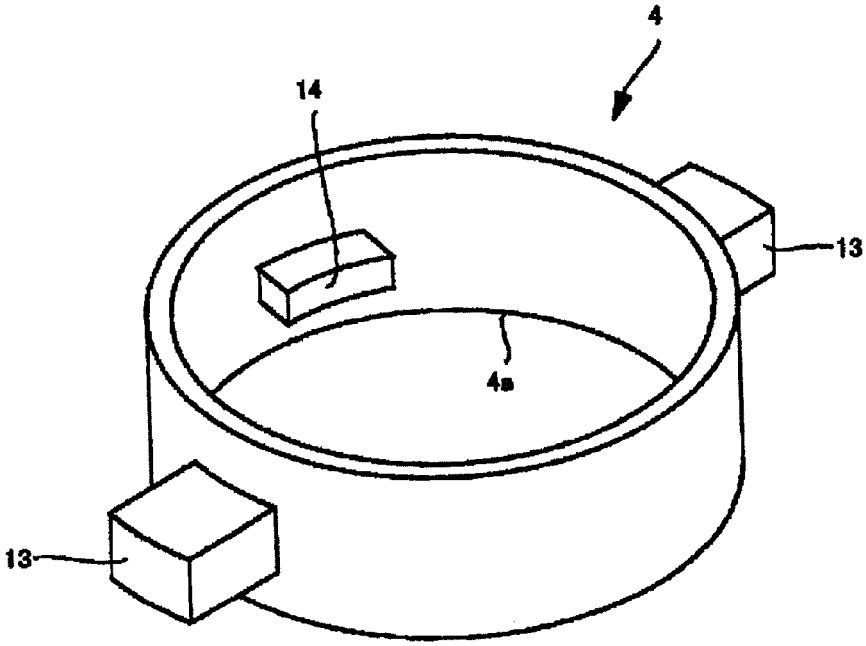
FIG. 4 is a perspective view showing an elastic ring body of the container in FIG. 1.

FIG. 4 shows the elastic ring body 4 which is to be incorporated into the cap body 3*c*. The elastic ring body 4 is formed from synthetic resin or metal to be deformable so that it can be restored. The elastic ring body 4 has a pair of push buttons 13 extending outwards from the periphery thereof in symmetrical positions. The ring body 4 is so formed that when the push buttons 13 and 13 are pushed toward each other, the ring body 4 reduces in diameter in the pressing direction and elastically deforms into an oval shape and that when the pressure having been applied thereto is released, it recover to the ring shape.

Further, the elastic ring body 4 is integrally provided at the inner peripheral surface thereof with projections 14 and 14 which function as second engaging sections referred hereinafter in detail. The projections 14 are arranged to be shifted from the positions the push buttons 13 are formed, in the circumferential direction of the elastic ring body 4, and in the example shown, the projections 14 and the push buttons 13 are in orthogonal positions.

The elastic ring body 4 is assembled inside of the cap body 3*c* such that the push buttons 13 and 13 are to be exposed outside through the holes 12 and 12 formed through the peripheral side wall 3*a* of the cap body. Such assembly can easily be made by elastically deforming the ring body 4.

The positions of the flexible wall pieces 15 of the cap body 3*c* and the radially inwardly extending projections 14 of the elastic ring body 4 are made such that the flexible wall pieces 15 are shifted from both the push buttons 13 and projections 14 in the circumferential direction of the elastic ring body 4 when the cap body 3*c* is assembled with the elastic ring body 4.

In the first embodiment, when the cap body assembled with elastic ring body 4 is pressed down against the neck section 5 of the container body 2, the radially inwardly extending projections 14 of the elastic ring body 4 come to engage with the second ring shaped protrusion 10 at the lower side of the neck section of the container body 2. Thus, the radially inwardly extending projections 14 of the elastic ring body 4 function as the second engaging sections.

Figure 5:
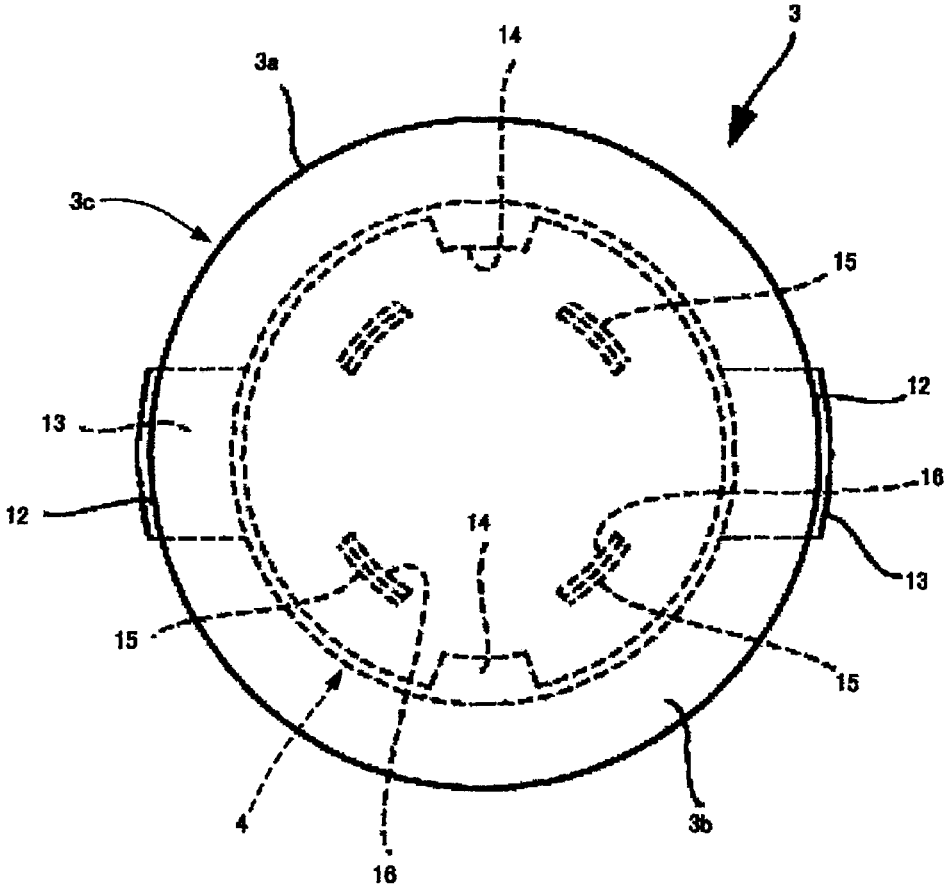
FIG. 5 is a plan view of the cap of the container in FIG. 1 seen from above.
Figure 6:
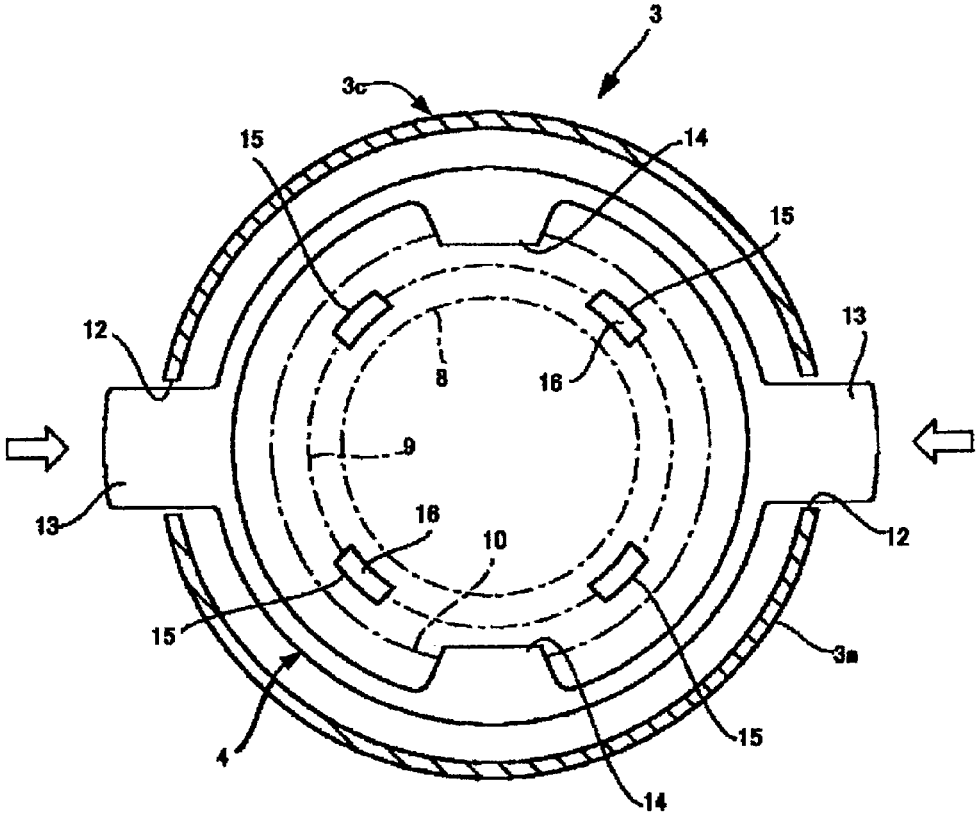
FIG. 6 is a horizontal sectional view of the cap of the container in FIG. 1 seen from below.

FIG. 5 shows a plan view when the cap 3 is seen from above and FIG. 6 shows a horizontal cross-sectional view when the cap 3 is seen from below. The push buttons 13 of the elastic ring body 4 assembled with the cap body 3*c* are arranged to penetrate the pair of through holes 12 in the cap body 3*c*, and as shown in FIG. 1, the push buttons 13 are exposed to the outside via the through holes 12. Then, when the push buttons 13 are pushed from the outside of the cap 3 to inwards of the cap 3 as shown in outline arrow directions in FIG. 6, the elastic ring body 4 is elastically deformed into an oval shape. The arrangement of the projections 14-14 on the elastic ring body 4 which function as the second engaging sections of the elastic ring body 4 is shifted from the positions the push buttons 13-13 are formed, in the circumferential direction of the elastic ring body 4, as described above.

<Detaching and Attaching Operation of Cap>

Figure 7:
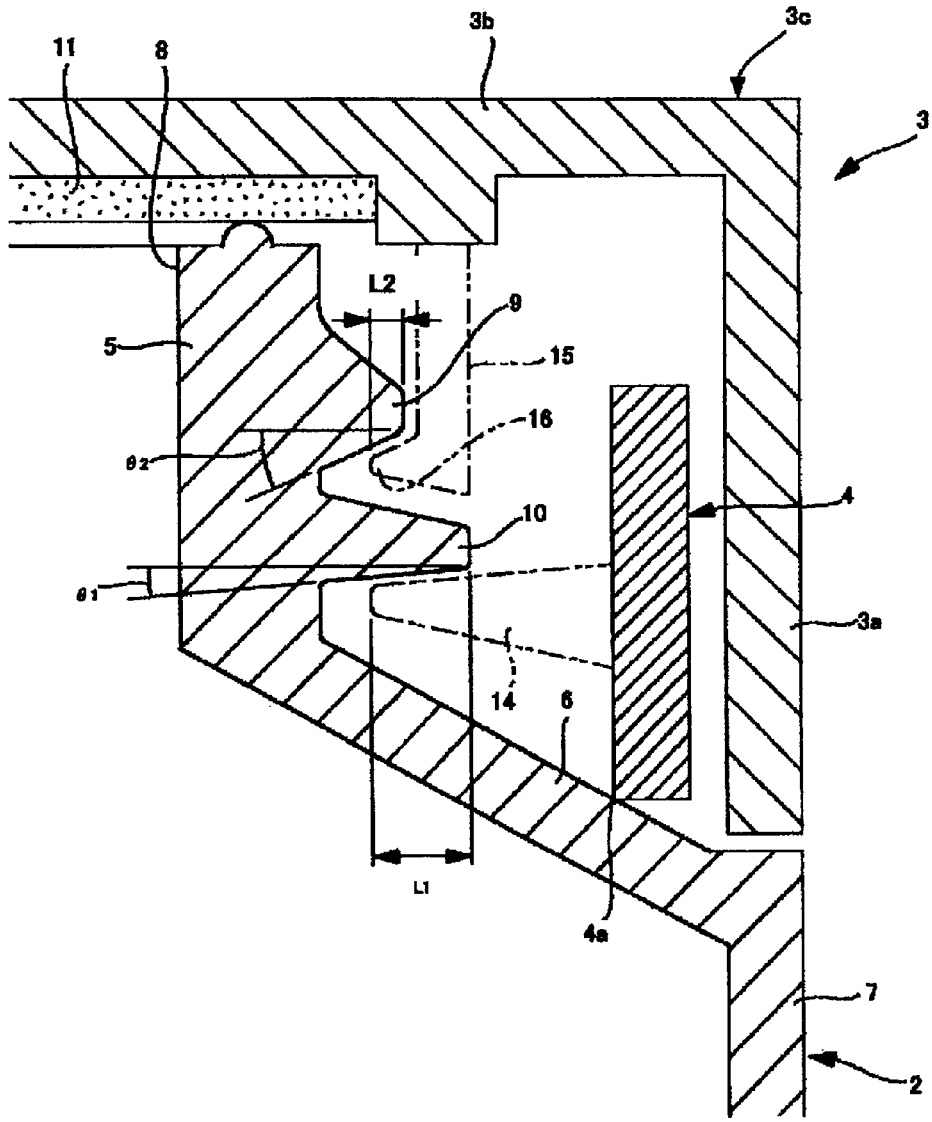
FIG. 7 is a cross-sectional view of an enlarged side of main parts of the container in FIG. 1.

FIG. 7 is a diagram showing a state in which the cap 3 is fitted to the container body 2, wherein a part above the cone section 6 is shown in an enlarged vertical section. As shown in FIG. 7, in the state that the cap 3 is fitted to the container body 2, the cylindrical peripheral side wall 3*a* of the cap surrounds the cone section 6 of the container body 2. Note that, in the fitted state, the cylindrical peripheral side wall 3*a* is set so that a slight space is formed in between the lower end thereof and the body section 7 of the container body 2, but the peripheral side wall 3*a* can be set to a size in which the lower end thereof and the body section 7 come in contact with each other. It is arranged that a lower inner peripheral edge 4*a* of the elastic ring body 4 comes in contact with the cone section 6 of the container body 2. Therefore, when the elastic ring body 4 is deformed into an oval shape, the elastic ring body 4 slides and gradually moves up the cone section 6 from the lower side toward the upper side. When the elastic ring body 4 gradually moves up the cone section 6, the push buttons 13 integrally formed with the elastic ring body 4 also move upwards. The push buttons 13 are engaged to the through holes 12 of the cap body 3*a*, and as a result, when the push buttons 13 are pressingly operated, the cap body 3*a* rises.

In the first embodiment, the first engaging sections 16 and the first ring shaped protrusion 9 form an engaging structure to maintain the position of the cap 3 so that the cap 3 does not shift and move in respect to the container body 2. However, when the cap 3 rises, with the bending deformation of the flexible wall pieces 15, the first engaging sections 16 can go over the first ring shaped protrusion 9 and separate therefrom.

On the other hand, the projections 14 on the ring body 4 and the second ring shaped protrusion 10 form a fitting structure to seal the opening 8 of the container body 2 and make the container body 2 airtight.

Note that, in the first embodiment, in the center of the top section 3*b* is provided with a plate shaped packing 11 that adheres closely to the opening rim 8 and that is arranged inwardly than the positions in which the flexible wall pieces 15 are provided. Further, a distance from an upper surface of the projection 14 on the elastic ring body 4 to the packing 11 of the cap 3 is set equal to or slightly shorter than a distance from a lower surface of the second ring shaped protrusion 10 to the opening rim 8. Therefore, when the projection 14 on the elastic ring body 4 and the second ring shaped protrusion 10 become engaged, the cap 3 is pulled down and the packing 11 is pressed against the opening rim 8. As a result, the opening rim 8 is sealed and the inside of the container body 2 is made airtight. Further, when the elastic ring body 4 is elastically deformed into an oval shape, the projections 14 on the ring body 4 move in a direction backward from the second ring shaped protrusion 10, mainly toward the outer side in the radial direction of the container body 2, and thus the projections 14 of the ring body 4 can separate upward beyond the second ring shaped protrusion 10.

Next is described a relationship between, an engagement of the first engaging sections 16 in respect to the first ring shaped protrusion 9 and an engagement of the projections 14 of the ring body 4 in respect to the second ring shape protrusion 10, in a state in which the cap 3 is fitted to the container body 2. In summary, this relationship sets an engaging degree between the projections 14 and the second ring shaped protrusion 10 stronger than an engaging strength between the first engaging sections 16 and the first ring shaped protrusion 9. Therefore, a high airtight performance with the projections 14 is obtained and at the same time an easier cap detaching operation with the first engaging sections 16 can be obtained.

Specifically, by pressingly operating the push buttons 13, the elastic ring body 4 is elastically deformed to an oval shape, and gradually moves up the cone section 6. At this time, since the engaging strength between the projections 14 on the ring body 4 and the second ring shaped protrusion 10 is strong, with just a slight elastic deformation of the elastic ring body 4, the projection 14 cannot separate from the second ring shaped protrusion 10 since the outward movement of the elastic ring body 4 at the engaging position is small. When the elastic ring body 4 largely elastically deforms and largely moves outward, the ring body 4 can separate from the second ring shaped protrusion 10.

On the other hand, the engaging strength between the first engaging sections 16 and the first ring shaped protrusion 9 is weaker than that between the projections 14 and the second ring shaped protrusion 10, and the first engaging sections 16 engaging the first ring shaped protrusion 9 bendingly deform the flexible wall pieces 15, even when the elastic ring body 4 slightly elastically deforms, and the cap 3 slightly rises with the moving up of the elastic ring body 4. When the flexible wall pieces 15 bendingly deform, the engaging state between the first engaging sections 16 and the first ring shaped protrusion 9 is released, and the first engaging sections 16 separate from the first ring shaped protrusion 9. Thus by setting the engaging strength in this way, a certain airtightness effect is realized with the projections 14 on the ring body 14 and the second ring shaped protrusion 10, and after the projections 14 have separated from the protrusions 10, the first engaging sections 16 are to separate with a light operation.

Note that, such a relationship of the engaging strength is adjusted by setting an engaging length L1 between the projections 14 on the ring body 4 and the second ring shaped protrusion 10 longer than the engaging length L2 between the first engaging sections 16 and the first ring shaped protrusion 9 (L1>L2). In the flexible deformation process of the elastic ring body 4, the projections 14 on the ring body 4 are maintained longer in the engaging state than the first engaging sections 16, and thus the projections 14 on the ring body 4 are harder to separate than the first engaging sections 16. After separation of the projections 14 that maintain airtightness, the first engaging sections 16 that hold the cap 3 in position is separated.

The relationship of the engaging strength can also be adjusted by setting an engaging angle θ1 between the projection 14 and the second ring shaped protrusion 10 smaller than an engaging angle θ2 between the first engaging sections and the first engaging protrusion 9 (θ1<θ2). In the elastic deformation process of the elastic ring body 4, the projections 14 that have a small engaging angle is harder to separate from the second ring shaped protrusions (10) than the first engaging sections 16 with a large engaging angle, and thus the engaging state of the projections 14 is maintained longer. Then, after the separation of the projections 14 that maintain airtightness, the first engaging sections 16 that hold the cap 3 in position are separated. Note that, when adjusting the engaging strength, one of the relationship of L1>L2 and the relationship of θ1<θ2 may be adopted. Of course, both relationships may be adopted.

With the container with the cap of the first embodiment, with both the length setting and the angle setting, after the projections 14 have separated from the second ring shaped protrusion 10, the first engaging sections 16 can be separated from the first ring shaped protrusion 9. In this way, in the state the cap 3 is fitted to the container body 2, with the first engaging sections 16 that engage the first ring shaped protrusion 9, the cap 3 is held in a formal position in respect to the container body 2, and with the projections 14 functioning as second engaging sections that engage the second ring shaped protrusion 10, the packing 11 of the cap 3 is adhered closely to the opening rim 8 of the container body 2, and the airtight state inside the container body 2 is maintained.

Figure 8:
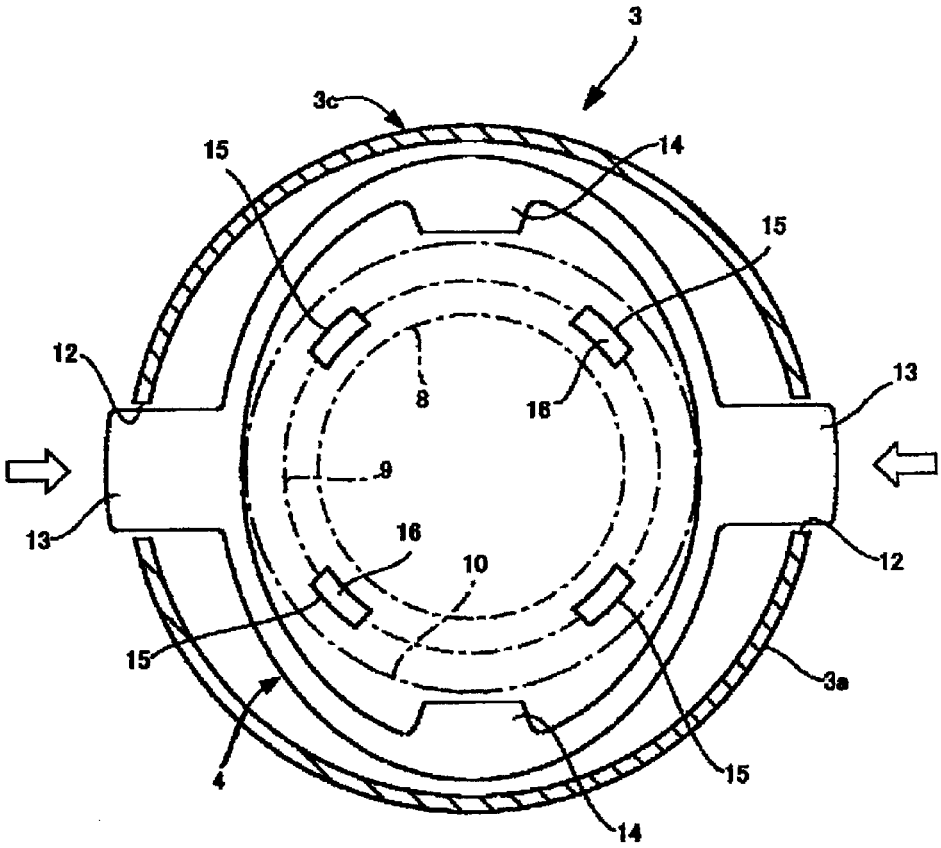
FIG. 8 is a horizontal cross-sectional view of the cap showing the state in which second engaging sections have been separated in the container in FIG. 1.
Figure 9:
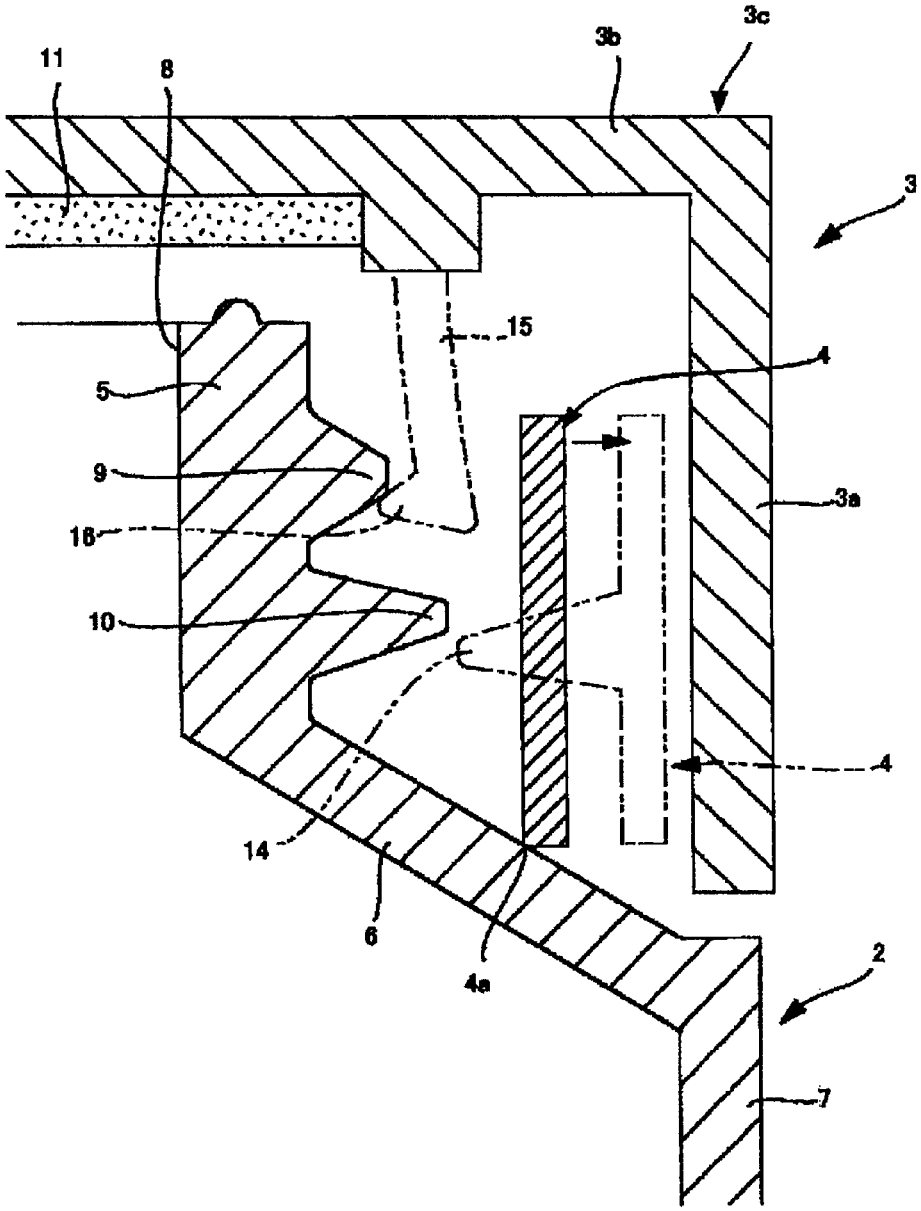
FIG. 9 is a cross-sectional view of an enlarged side of the main part showing the state in which the second engaging sections have been separated in the container in FIG. 1.
Figure 10:
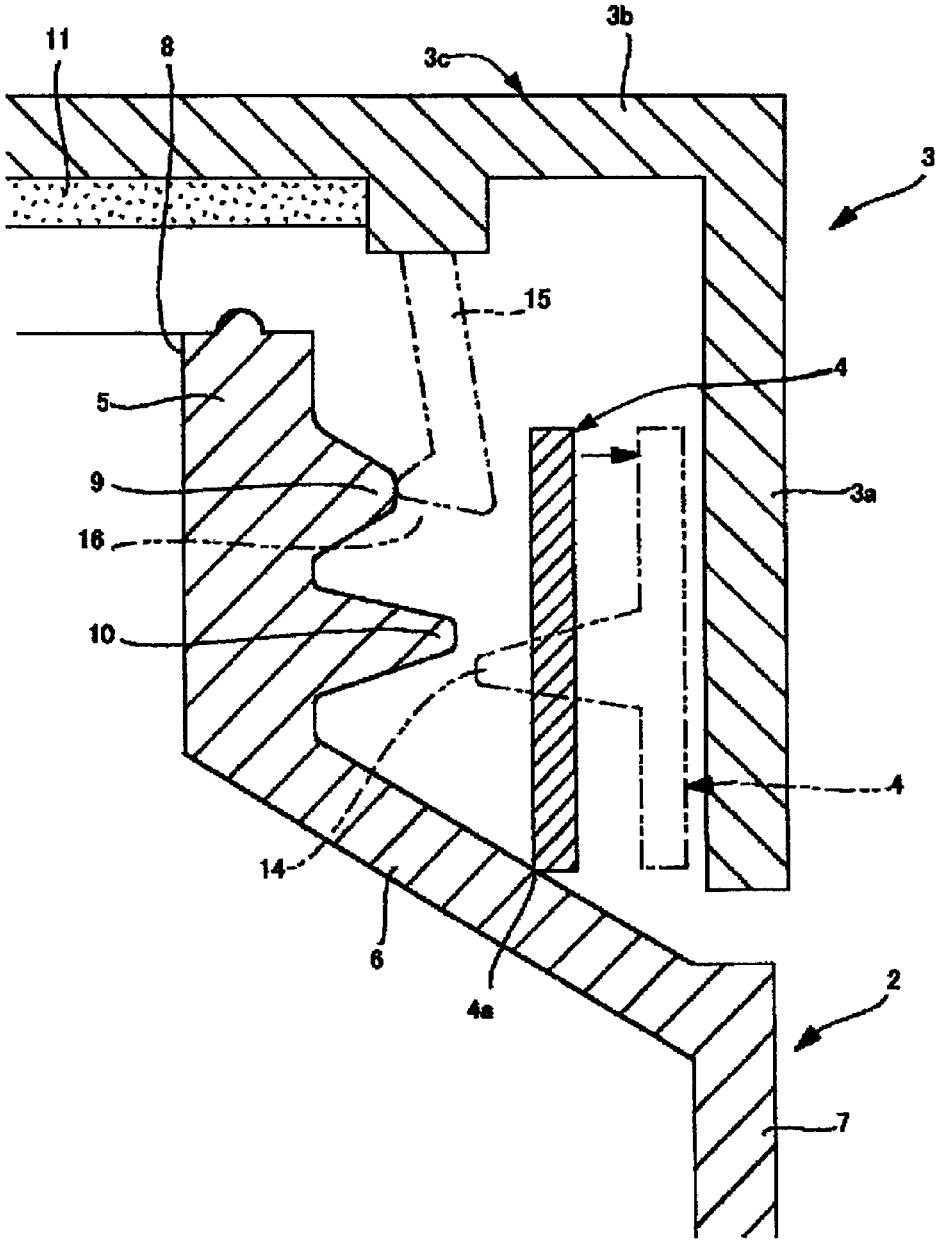
FIG. 10 is a cross-sectional view of an enlarged side of the main part showing the state in which first and the second engaging sections have been separated in the container in FIG. 1.

Next, the action when taking off the cap 3 fitted to the container body 2 is specifically described. FIGS. 8 to 10 show the deformed state of each section of the cap 3 accompanying the taking off operation. FIG. 8 is a plan view showing a deformed state of the elastic ring body 4 accompanying the pressing the push buttons 13. FIGS. 9 and 10 are partially enlarged cross-sectional views showing the change of the engaging state between the first and second engaging sections and the first and second ring shaped protrusions (9, 10). When taking off the cap 3 fitted to the container body 2, the pair of the push buttons 13 are sandwiched from both sides with fingers of one hand so as to be pressed from the outside toward the inner side of the cap 3. When the push buttons 13 are pressed, the elastic ring body 4 is elastically deformed into an oval shape, and the elastic ring body 4 beings to gradually move up the cone section 6. With the rise of the elastic ring body 4, the cap 3 also begins to rise. But, in the case that the pressing amount of the push buttons 13 is small, and the degree of the elastic deformation is small, the second engaging sections 14 and the second ring shaped protrusion 10 continue to maintain the engaging state.

Continually, when the push buttons 13 are further pushed in and the elastic ring body 4 is elastically deformed largely, as shown in FIG. 8, the projections 14 on the ring body 4 move outward to positions in which the projections 14 can separate from the second ring shaped protrusion 10. The elastic ring body 4 gradually moves up the cone section 6 with a large slide amount at the same time as the outward movements of the projections 14, and as a result the cap 3 largely rises. At this time, the projections 14 move upwards at the side of the second ring shaped protrusion 10, without running on the second ring shaped protrusion 10. That is, the projections 14 separate from the second ring shaped protrusion 10. With this separation, the pressing strength of the packing 11 to the opening rim 8 of the body section 7 decreases, and the inside of the container body 2 that was in a sealed state is released.

Following the stage that the projections 14 separate from the second ring shaped protrusion 10, the first engaging sections 16 flexibly deform the flexible wall pieces 15 as shown in FIG. 9, and go over the first ring shaped protrusion as shown in FIG. 10 with a clicking feeling, thereby separating from the first ring shaped protrusion 9. With the first engaging sections 16 separating from the first ring shaped protrusion 9, the effect of holding the position of the cap 3 in respect to the container body 2 is released. Then, the cap 3 is taken off from the container body 2.

Note that, in the above description, the case in which the projections 14 on the elastic ring body 4 functioning as the second engaging sections and the first engaging sections 16 are separated from the second and first protrusions 10 and 9 on the container body 2, respectively, in order has been described, but the separation of these engaging sections (14, 16) can be set to occur approximately simultaneously. In any event, the projections 14 on the ring body 4 separate from the second ring shaped protrusion 10 with the elastic ring shaped body 4 elastically deforming greatly, without the projections 14 being caught on the second ring shaped protrusion 10. Further, the first engaging sections 16 separate smoothly from the first ring shaped protrusion 9, via a weak engagement, with a rising force of the cap 3 caused by the moving up of the elastic ring body 4.

On the other hand, when fitting the cap 3 to the container body 2, the cap 3 may be covered from above the container body 2 and pressed downwards. When the cap 3 is pressed downwards, with the bending deformation of the flexible wall pieces 15, the first engaging sections 16 go over the first ring shaped protrusion 9, thus causing the clicking feeling, and the first engaging sections 16 engage below the first ring shaped protrusion 9. The projections 14 on the elastic ring body 4 functioning as the second engaging sections go over the second ring shaped protrusion 10, with the elastic deformation of the elastic ring body 4 in the radial direction, and the projections 14 engage under the second ring shaped protrusion 10. When the first engaging sections 16 engage the first ring shaped protrusion 9, the position of the cap 3 is maintained in respect to the container body 2, and a shift in movement between the container body 2 and the cap 3 is prevented. Specifically, by the projections 14 engaging the second ring shaped protrusion 10, the airtightness inside the container body 2 is maintained, and the lower inner peripheral edge 4*a* of the elastic ring body 4 is made to come in contact on the cone section 6, and the cap 3 is held in position above the body section 7 of the container body 2.

Effects of Invention

According to this embodiment described above, the container includes the first engaging sections 16 provided to the cap 3, which are engaged to the first ring shaped protrusion 9 to hold the position of the cap 3 to the container body 2 and are separated from the first ring shaped protrusion 9 with the rise of the cap 3. The container further includes the projections 14 provided to the elastic ring body 4, which are engaged with the second ring shaped protrusion 10 to airtightly close the opening rim 8 of the container body 2 by lowering the cap 3 downwards and are separated from the second ring shaped protrusion 10 with the elastic deformation of the elastic ring body 4. Thus, with the first engaging sections 16, the cap 3 can be maintained in position in respect to the container body 2 so as not to shift and move, and also with the projections 14 functioning as the second engaging sections, the cap 3 can airtightly close the opening rim 8 of the container body 2.

Therefore, the container 1 with the cap of this embodiment can store contents with high volatility, and can be used under an environment in which the cap 3 is pressed upwards when the internal pressure of the container body 2 becomes higher than the outside air pressure.

Further, with the elastic deformation of the elastic ring body 4, the projection 14 functioning as the second engaging sections that ensure airtightness of the container body 2 are made to separate beyond the second ring shaped protrusion 10 and without running on the second ring shaped protrusion 10, thus the cap 3 can be taken off from the container body 2 easily with a light operating force.

Further, with the clicking feeling that is obtained when the first engaging sections 16 engage, the opening and closing operation of the cap 3 can be known.

By setting the engaging degree between the second engaging sections and the second ring shaped protrusion 10 stronger than the engaging degree between the first engaging sections 16 and the first ring shaped protrusion 9, the engaging effect of the second engaging sections 14 that maintain airtightness can be surely ensured, and a high level of airtightness can be accurately maintained.

By setting the engaging length L1 between the second engaging sections and the second ring shaped protrusion 10 longer than the engaging length L2 between the first engaging sections 16 and the first ring shaped protrusion 9, the engaging strength can be appropriately adjusted. By setting the engaging degree θ1 between the second engaging sections and the second ring shaped protrusion 10 smaller than the engaging degree θ2 between the first engaging sections 16 and the first ring shaped protrusion 9, the engaging strength can be appropriately adjusted.

By providing the first engaging sections 16 with intervals therebetween in the circumferential direction of the circumferential peripheral side wall 3*a* of the cap 3, flexibility can be increased when fitting the cap 3 to the container body 2. By providing the first engaging sections 16 along an entire periphery in the circumferential direction of the circumferential peripheral side wall 3*a* of the cap 3, the ability to maintain the position of the cap 3 in respect to the container body 2 can be increased.

Since the ring shaped protrusions (9, 10) are structured from the first ring shaped protrusion 9 to which the first engaging sections 16 engage and the second ring shaped protrusion 10 to which the second engaging sections engage, the engaging strength required for each engaging section (14, 16) can be easily and appropriately set.

Modified Example

With the container with the cap of the first embodiment described above, two projections 14 functioning as the second engaging sections are arranged in a pair, and are formed in positions along the major axis direction when the elastic ring body 4 is elastically deformed into an oval shape. Of course, the number of the projections 14 may be equal to or more than three. Further, the flexible wall pieces 15 are arranged with intervals therebetween, but the flexible wall pieces 15 can be formed in a tubular form along the entire periphery in the circumferential direction of the peripheral side wall 3*a* of the cap 3. In this case, the first engaging sections 16 can be formed with intervals therebetween, or can be formed continuously along the entire periphery.

Figure 11:
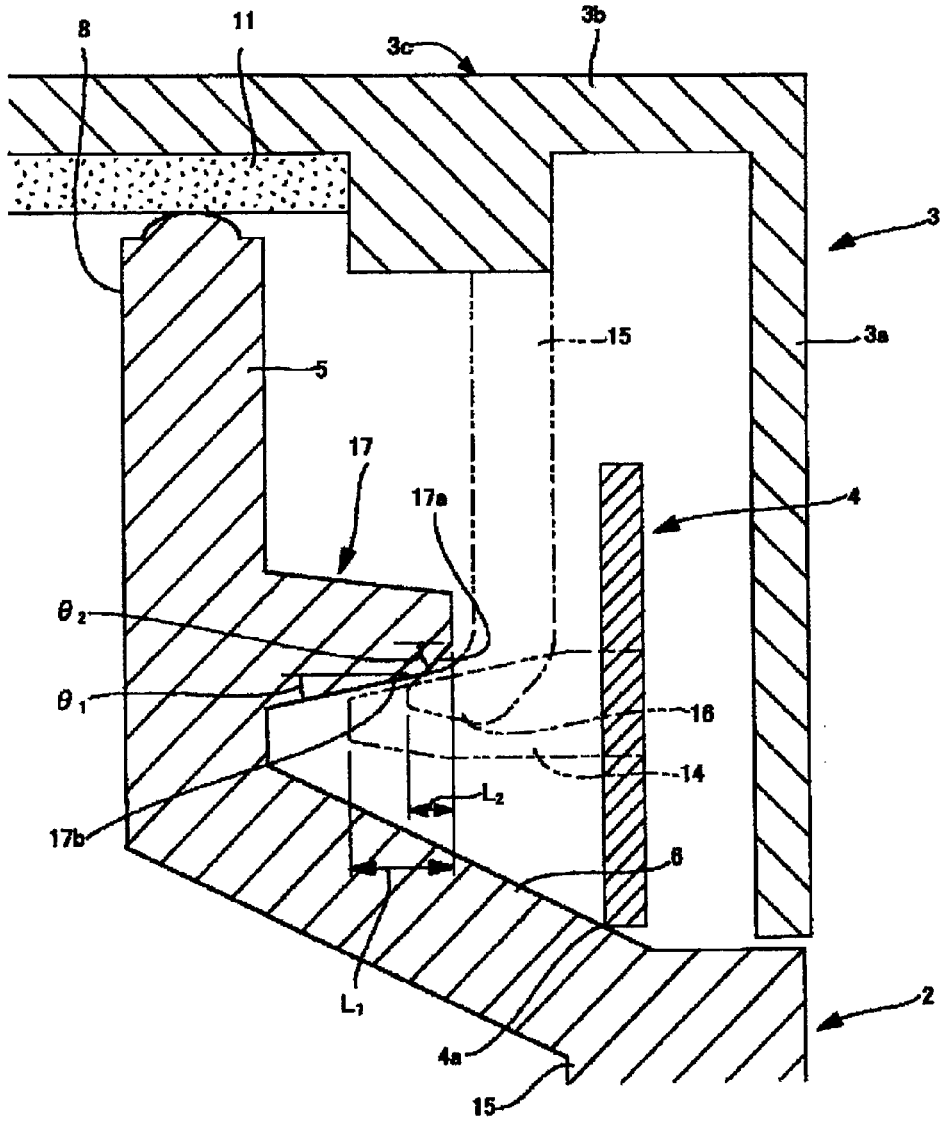
FIG. 11 is a cross-sectional view of an enlarged side of the main part of a modified example of the container shown in FIG. 1.

Further, the first ring shaped protrusion 9 and the second ring shaped protrusion 10 can substantially be the same sections. FIG. 11 shows a modified example in which the first ring shaped protrusion 9 and the second ring shaped protrusion 10 are integrally formed as a single ring shaped protrusion 17. In this modified example, both the first and the second engaging sections (14, 16) are to be engaged. A tip end lower surface 17*a* of the single ring shaped protrusion 17 is set with a large inclination angle θ2, and the continuing lower surface section 17*b* is set with a small inclination angle θ1. Further, with the first and second engaging sections (14, 16) that engage the single ring shaped protrusion 17, an engaging length L2 of the first engaging sections 16 is set short, and the engaging length L1 of the second engaging sections 14 is set long. In this modified example shown in FIG. 11, the single ring shaped protrusion 17 is provided, so the height of the container body 2 can be made smaller, and the container with the cap 1 can be made more compact. In these modified examples, the above effects can of course be obtained.

Second Embodiment

Regarding the First Embodiment

In the first embodiment, the engaging section structured by the first engaging sections 16 and the first ring shaped protrusion 9 is released with the rise of the cap 3, and the fitting section structured with the second engaging sections 14 and the second ring shaped protrusion 10 is released with the elastic deformation of the elastic ring body 4 in the radial direction. Thus, with the container 1 with the cap in the first embodiment, in respect to the force in the vertical upward direction, the fitting sections (10, 14) are made so that they do not separate unless there is provided a force in the horizontal direction to press the push buttons 13. Thus, the container 1 with the cap in the first embodiment has an advantage that the airtightness inside the container body 2 is maintained to a certain degree, even if a force is added to make only the cap 3 rise without elastically deforming the elastic ring body 4.

In the first embodiment, however, the elastic ring body 4 has the push buttons 13 formed in the peripheral surface thereof to be exposed from two opposed through holes provided in the cylindrical peripheral wall 3*a* and is assembled along an internal circumference of the cylindrical peripheral wall 3*a*. The second engaging sections (hereinafter, fitting projections) 14 are formed on the peripheral surface of the elastic ring body 4 in positions orthogonal to the push buttons 13. The relationship of the arrangement of these sections (13, 14) are necessary positional relationships to deform the elastic ring body 4 by pressing the push buttons 13 in the radial direction, and making the fitting projections 14 move horizontally outward in the radial direction. For example, in the case that only the cap body 3*c* is strongly pulled upwards, without pressing the push buttons 13, to take off the cap 3 from the container body 2 with force, or in the case that an internal pressure of the container body 2 is extremely high, and a force to strongly push up the cap 3 from the inside occurs, the push buttons 13 exposed to the outside of the cylindrical peripheral wall 3*a* via the two through holes 12 are urged upwards, and accompanying this the elastic ring is pushed upwards. But, since the elastic ring body 4 is not elastically deformed to an oval shape, the fitting sections (10, 14) maintain their engaged state. Thus, the sections in which the push buttons 13 are formed on the elastic ring body 4 are bent upwards.

If the elastic ring body 4 is bent in this way, the bent section will rise substantially, and the engagement states of the engaging section (9, 16) with weak engaging strengths will be slightly released, while the strong engagement state (hereinafter, fitted state) with the fitting sections (10, 14) is maintained. Namely, the "rising up" of the cap 3 will occur. As a result, close adhesion between the packing 11 provided to the top section 3*b* inside the cap body 3*c* and the upper end of the opening rim 8 of the container body 2 weakens, and there is the possibility that the airtightness inside the container body 2 may be lost. When the possibility of losing such airtightness was actually discussed from various angles, it became known that, during air transportation in which there are large changes in air pressure, there occurred loss of airtightness accompanying the bending deformation of the elastic ring body 4. The container with the cap in the second embodiment of this invention is a container with a cap that can further strongly maintain the airtightness inside the container body.

<Structure>

Figure 12:
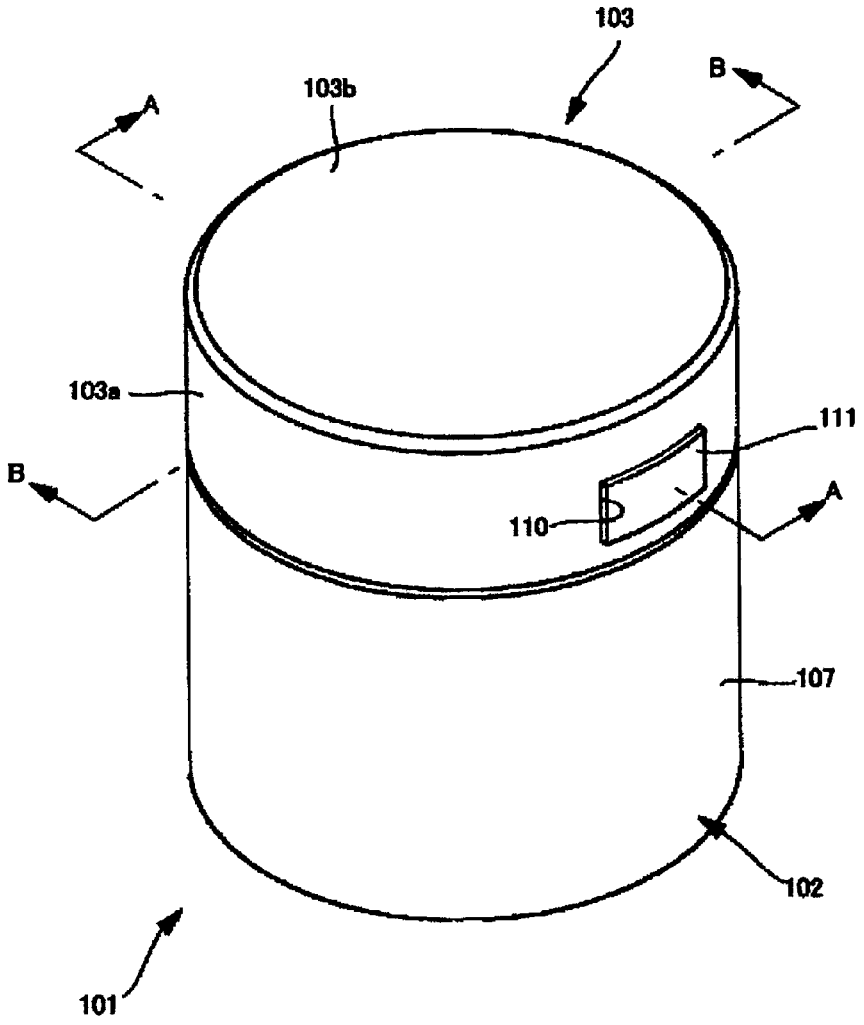
FIG. 12 is an overall perspective view showing a container of a second embodiment of the present invention.

Hereinbelow, the structure of the container with the cap of the second embodiment of this invention and the detaching/attaching action of the cap and the like is described. FIG. 12 is an overall perspective view of the container with the cap of the second embodiment. As shown, the external shape of the container 101 with a cap of the second embodiment is approximately the same as the container 1 with the cap of the first embodiment, and in the upright state, a cap 103 that can be attached and detached to and from the upper side of a container body 102 is fitted. Push buttons 11 provided to the internal structure of the cap 103 are exposed from through holes 110 perforated in a cylindrical peripheral wall 103*a*.

Figure 13:
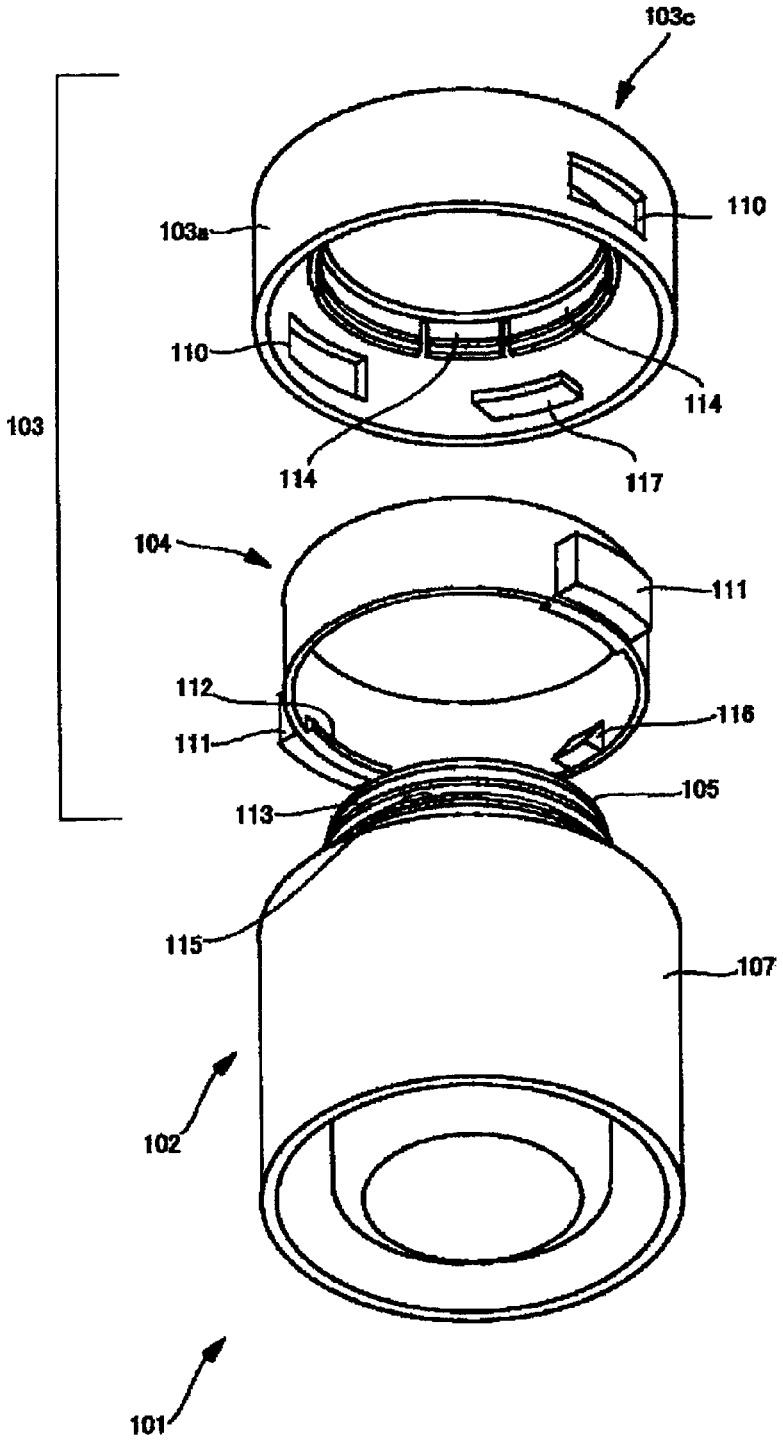
FIG. 13 is an exploded perspective view of the container shown in FIG. 12 seen from below.
Figure 14A:
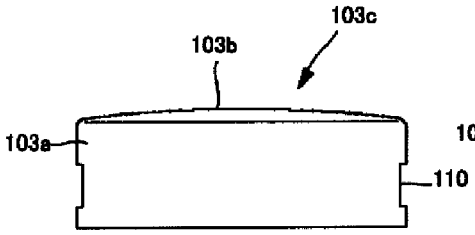
FIGS. 14A to 14E are explanatory views explaining a cap, an elastic ring body, and a container body structuring the container shown in FIG. 12.
Figure 14B:
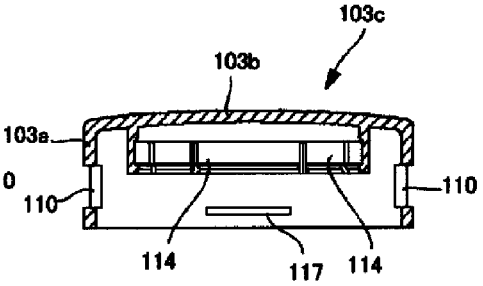
Figure 14C:
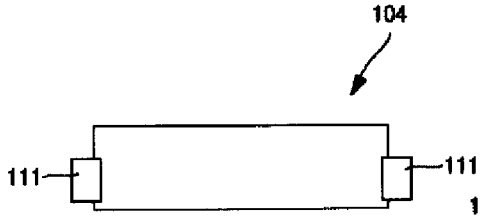
Figure 14D:
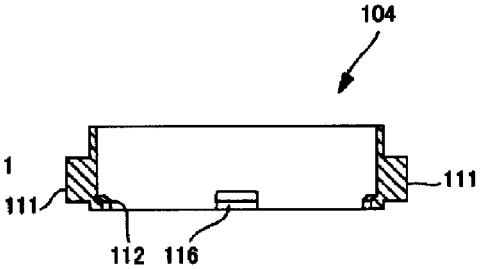
Figure 14E:
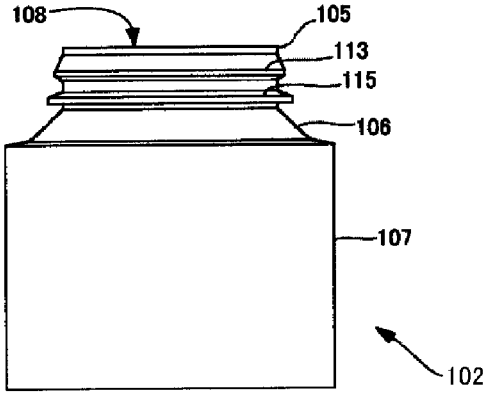

FIG. 13 and FIGS. 14A to 14E show the state in which the container 101 with the cap has been separated into each section. FIG. 13 is a fragmented perspective view, FIG. 14A is a side view of a cap body 103*c*, FIG. 14B is a side sectional view of the cap body 103*c*, FIG. 14C is a side view of the elastic ring body, FIG. 14D is a side sectional view of the elastic ring body, and FIG. 14E is a side view of the container body. The container 101 with the cap of the second embodiment is structured from, similarly to the first embodiment, mainly the container body 102 that stores contents inside, the cap 103 that is fitted to the container body 102 from above, and an elastic ring body 104 provided inside the cap 103.

The container body 102 is formed in a jar form or a hollow tube form, with a synthetic resin, metal, or glass as the raw material. In the example shown, the outer contour in plan view is circular, but of course, it may be a polygonal or an oval shape. The upper end of the container body 102 is an opening rim 108 to take out the contents, and from the opening rim 108 a neck section 105 with a small diameter continues downwards. From the lower end of the neck section 105 is formed a cone section 106 that is formed enlarging toward the lower side. In this example, the cone section 106 is formed with a smaller outside diameter at the upper side and a larger outside diameter at the lower side, and is a ring shaped slope that is inclined outwards toward the lower side, along the entire periphery in the circumferential direction of the container body 2. The lower end of the cone section 106 continues to a body section 107 with a large diameter, and reaches a bottom section of the container body 102. The peripheral surface of the neck section 105 of the container body 102 is formed with, along its entire periphery in the circumferential direction, an engaging protrusion 113 that corresponds to a first ring shaped protrusion section 9 in the first embodiment and a fitting protrusion 115 that corresponds to the second ring shaped protrusion section 10. In this example, the engaging protrusion 113 is formed above the fitting protrusion 115.

The cap 103 has a structure in which the elastic ring body 104 is incorporated in the cap body 103*c* formed of a synthetic resin or a metal, and the cap body 103*c* includes the cylindrical peripheral wall 103*a* and a top section 103*b* covering a top end of the cylindrical peripheral wall 103*a*, and is formed in a hollow shape. This cap body 103*c* is also not limited to a circular horizontal sectional shape and can be an appropriate shape that matches the shape of the container body 102 such as an orthogonal shape or an oval shape.

At the center of the lower surface of the top section 103*b* is provided a packing 109 that is a plate shape or that corresponds to the diameter of the opening rim 108, and the packing is made to adhere closely with the opening rim 108. The cylindrical peripheral wall 103*a* of the cap body 103*c* is penetratingly formed with a pair of through holes 110 that face each other in the diameter direction of the cap body 103*c*. From the top section 103*b* of the cap 103 are formed hanging down engaging pieces 114 that are elastically deformable. Note that, the engaging pieces 114 serve to function as the flexible wall sections 15 with the first engaging sections 16 in the first embodiment.

Note that, the engaging pieces 114 can engage to the engaging protrusion 113 on the container body 102, and with the engaging pieces 114 and the engaging protrusion 113, an engaging section is structured between the cap 103 and the container body 102. Each engaging piece 114 is formed with an appropriate interval along the circumferential direction of the neck section 105. The positions of the engaging protrusion 113 and the engaging pieces 114 are at least between the through holes 110 when fitting the cap 103 to the container body 102.

Further, the cap body 103*c* is formed with a brim piece 117 that protrudes inwards in the radial direction, at the inner side of the cylindrical peripheral wall 103*a*. This brim piece 117 has a function of preventing bending deformation of the elastic ring body 104 being urged upwards when the push buttons 111 are exposed to the outside of the cap 103, as described above.

The elastic ring body 104 assembled to the inner side of the cap body 103*c* is formed elastic-deformably and is made of a synthetic resin or metal. The outer contour in plan view of the elastic ring body 4 is formed in a circular shape. The elastic ring body 104 is not limited to a circular shape and may also be formed in an orthogonal shape or an oval shape. The push buttons 111 are formed integrally to the peripheral surface of the elastic ring body 104. Similarly to the first embodiment, a pair of the push buttons 111 are provided matching the positions of the pair of through holes 110 of the cap 103, and are exposed to the outside of the cap 103 via the through holes 110, and when the push buttons 111 are pressed from the outside of the cap 103 toward the inner side, the elastic ring body 104 deforms to reduce in diameter in the pressing direction, and the planer shape elastically deforms into an oval shape with the long axis that is approximately orthogonal with the pressing direction. Note that, in this example, on the inner peripheral surface of the elastic ring body 104 are formed guide protrusions 112 in positions corresponding to the push buttons 111. These guide protrusions 112 are for improving slidability on the cone section 106.

Further, on the inner peripheral surface of the elastic ring body 104 is formed a fitting piece 116 toward the inner side in the radial direction. This fitting piece 116 has a function similar to the second engaging section 14 in the first embodiment. Namely, the fitting piece 116 structures the fitting section together with the fitting protrusion 115 and fits to the fitting protrusion 115 of the container body 102. The fitting piece 116 is provided to be shifted in position from the push buttons 111, in the circumferential direction of the elastic ring body 104, and when pressing the push buttons 111, as the elastic ring body 104 is elastically deformed the moving distance of the fitting piece 116 becomes preferably largest. Therefore, the fitting piece 116 is preferably provided in two positions that are orthogonal to the push buttons 111, in the circumferential direction of the elastic ring body 104.

Note that, since the fitting section should be in a positional relationship such that the fitting protrusion 115 on the container body 102 and the fitting piece 116 on the ring body 104 can be engaged, the fitting protrusion 115 can be provided at least in position where the fitting piece 116 locates. Further, the engaging protrusion 113 and the fitting protrusion 115 do not have to be in two levels at the upper and lower, but can be made as one common part. In this case the engaging pieces 114 can be arranged with an interval therebetween, and the fitting piece 116 can be arranged therebetween.

The container 102 with the cap of the above structure is provided in which the cap body 103*c* and the elastic ring 104 are integrally assembled. In order to obtain the cap 103 with the elastic ring 104 integrated in the cap body 103*c*, the elastic ring body 104 that has been elastically deformed by pressing the push buttons 111, is made to go over the brim piece 117 of the engaging section, into the inner side of the cylindrical peripheral wall 103*a*, and pushed in, and the push buttons 111 are matched in position to the through holes 110. In that way, the push buttons 111 are exposed from the through holes 110, and the elastic ring body 104 is elastically restored, and the elastic ring body 104 and the cap body 103*c* are assembled. With this assembly, the elastic ring body 104 and the cap body 103*c* are engaged to each other via the engaging section, and integrated closely.

<Detaching and Attaching Action of the Cap>

Figure 15:
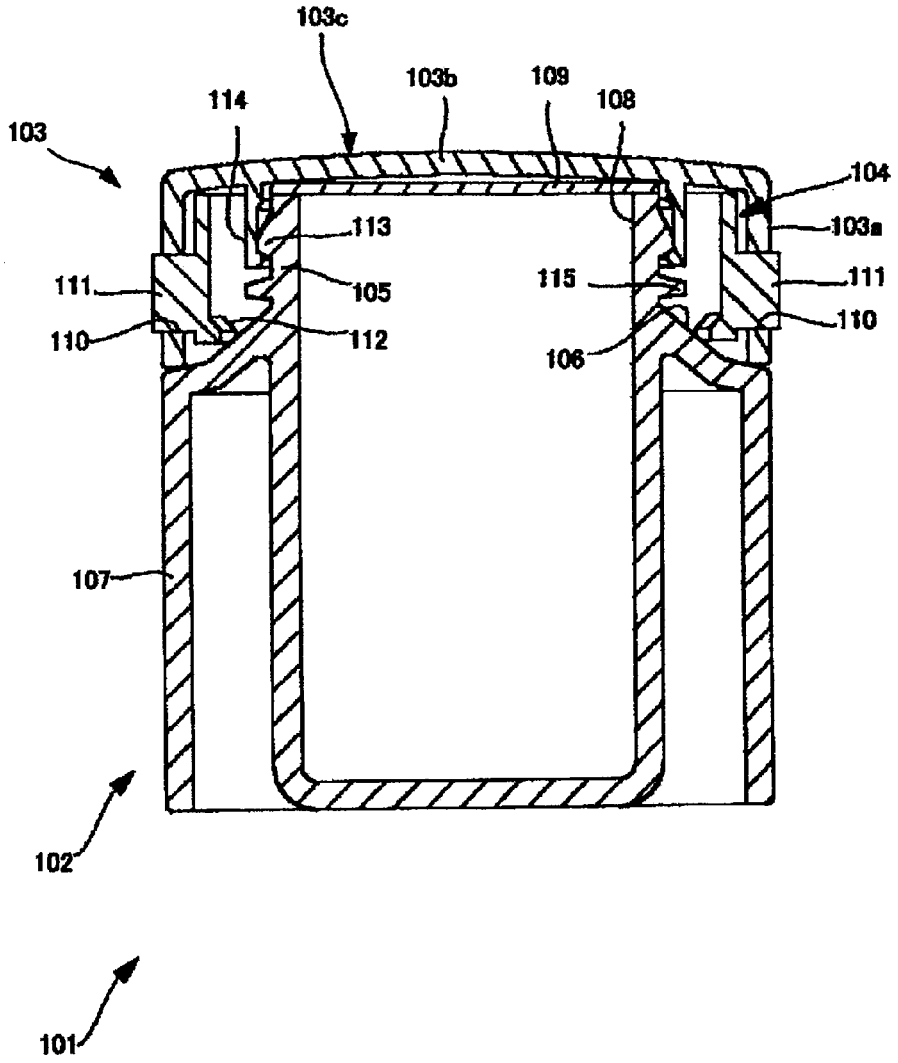
FIG. 15 is a cross-sectional view on arrow A-A in FIG. 12.
Figure 16:
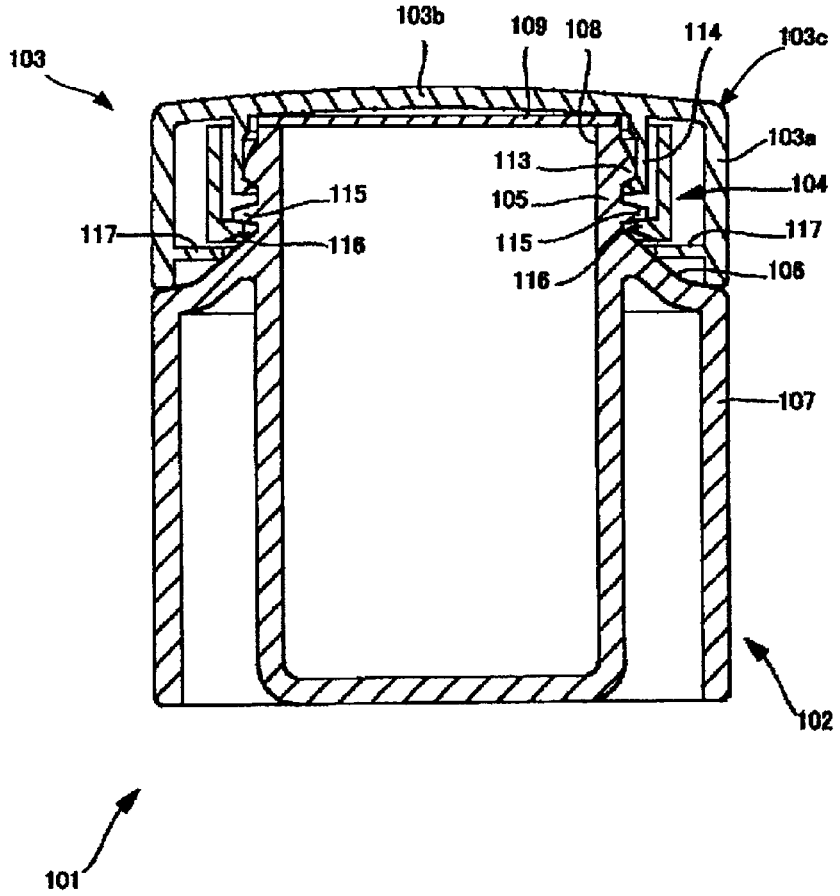
FIG. 16 is a cross-sectional view on arrow B-B in FIG. 12.

FIGS. 15 and 16 are side sectional views of the container 101 with the cap when the cap 103 is fitted to the container body 102. FIG. 15 corresponds to an A-A line arrow view of FIG. 12, and FIG. 16 corresponds to a B-B line arrow view of FIG. 12. When the cap 103 is covered from above to the container body 102 and pressed down, the engaging pieces 114 of the engaging section elastically deform and engage to below the engaging protrusion 113, and also the elastic ring body 104 elastically deforms and the fitting piece 116 fits under the fitting protrusion 115. With the engagement of the engaging section, the cap body 103*c* is held onto the container body 102, and with the fitting of the fitting section, the elastic ring body 104 is fitted on the container body 102.

Then, when the cap 103 is fitted to the container body 102 in this way, the elastic ring body 104 and the cap body 103*c* are closely integrated. The brim piece 117 is close to or comes in contact with the lower end of the elastic ring body 104.

Next, the action in taking off the cap 103 is described. The elastic ring body 104 is arranged along the inner periphery of the cylindrical peripheral wall 103*a* of the cap body 103*c*, and the vertical position of the elastic ring body 104 is between the cap body 103*c* and the neck section 105 or the cone section 106 of the container body 102, and the lower inner peripheral edge of the elastic ring body 104 is in contact on the cone section 106. When the push buttons 111 are pressed and the elastic ring body 104 is elastically deformed on the cone section 106, the elastic ring body 104 is elastically deformed into an oval shape without being obstructed by the brim piece 117. The fitting pieces 116, of the elastic ring body 104 that has been elastically deformed, move outward from the fitting protrusion 115 of the container body 102 and the fitting section is disengaged, and together with this disengagement the elastic ring body 104 starts to move up along the cone section 106. With the moving up of the elastic ring body 104, the guide protrusion 112 contacts along the peripheral shape of the cone section 106, so that the elastic ring body smoothly moves up.

When the elastic ring body 104 starts to move up, the cap 103 starts to rise, the engaging pieces 114 of the cap body 103*c* are elastically deformed and go over the engaging protrusion 113 of the container body 102, and the engaging section is disengaged. After the disengagement of the engaging section, the cap 103 rises with the moving up of the elastic ring body 104, and thus the cap 103 can be taken off from the container body 102. After taking off the cap 103, when the fingers pressing the push buttons 111 are released, the elastic ring body 104 is elastically restored, and the push buttons are restored to the positions before the pressing operation.

In such a taking off action of the cap 103, the release strength of the engaging section is preferably a strength in which the cap 103 can easily rise and separate smoothly when the elastic ring body 104 is pressed. If the release strength is too weak, however, the fitting between the cap body 103*c* and the container body 102 will depend on only the fitting pieces 116 formed on the push buttons 111. When the elastic ring body 104 is greatly elastically deformed, the fitting pieces 116 move to the outside in the radial direction of the neck section 105 and separate from the fitting protrusion 115, and in this way the elastic ring body 104 separates from the container body 102. Namely, the fitting section separates not with the elastic effect of the fitting piece 116, but with the elastic deformation effect of the elastic ring body 104. On the other hand, the engaging section separates with the elastic deformation effect of the engaging pieces 114 that can elastically deform, and in respect to the rising of the cap 103, the strength to release the fitting state of the fitting section (fitting strength) is larger than a strength to release the engaging state of the engaging section (engaging strength).

Note that, the fitting pieces 116 are preferably positioned in two positions orthogonal to the push buttons 111, but with this alone the cap body 103*c* easily inclines in respect to the container body 102, and even if the cap body does not easily separate, stable airtightness cannot be maintained. Thus, in view of the above the above engaging strength and fitting strength need to be adjusted. Preferably, to prevent an accidental separation, the fitting strength is generally a strength in which when only the cap 103 is pulled upwards without pressing the push buttons 111 the cap does not separate, and when the push buttons 111 are pressed and the elastic ring body 104 is deformed the cap can easily separate. More specifically, preferably the release strength of the engaging section is 1N to 15N, and the release strength of the fitting section is equal to or more than 10N in a state in which the elastic ring body 104 is not elastically deformed on purpose in the radial direction. Note that, these strength adjustment, similar to the first embodiment, can be adjusted depending on the length and angle relating to the engagement of the engaging protrusion 113 and the engaging piece 114 corresponding to the above L2 and θ2, or the length and angle relating to the fitting of the fitting protrusion 115 and the fitting piece 116 corresponding to the above L2 and θ2.

<Function of Engaging Supporting Section>

By the way, in the second embodiment, contrary to the first embodiment, an engaging supporting section to prevent bending of the above described elastic ring body 104 is provided. That is, a brim piece 117 is provided. This brim piece 117 is the largest feature of the container 101 with the cap in the second embodiment. Hereinbelow, the function of this brim piece 117 is described more specifically.

First, suppose that, the brim 117 is not provided to the container 102 with the cap in the second embodiment. In the state in which the cap 103 is fitted to the container body 102, and a force is added to separate the cap without pressing the push buttons 111, the force is transferred to the elastic ring body 104 via the push buttons 111 that are in contact with the though holes 110 of the cap 103. Two fitting pieces 116, of the elastic ring body 104, that hold the fitting with the container body 10 are formed in positions orthogonal with the push buttons 111, thus the elastic ring body 104 that is originally formed elastically deformably bends due to the above force that acts thereon. Then, with the fitting maintained, only the engaging section with a weak releasing strength separates slightly, and the airtightness inside the container body 102 decreases. But, with the container 102 with the cap of the second embodiment, when the cap 103 tries to rise without any action to take it off, the brim piece 127 comes in contact with the lower end of the elastic ring body 104 and supports the elastic ring body 104 from below. Thus, the bending of the elastic ring body 104 is prevented, and the airtightness inside the container body 102 can be maintained at a high level.

<Effects>

With the container 101 with the cap of the second embodiment as described above, the cap body 103*c* and the elastic ring body 104 can be integrated closely without any play with an engaging supporting section, specifically the brim piece 117 that supports the lower end of the elastic ring body 104 from below. Further, even if only the sections of the push buttons 111 are pulled upwards in a state in which the fitting pieces 116 formed on the inner surface of the elastic ring body 104 are fitted to the fitting protrusion 115, the elastic ring body 104 does not bendingly deform. Thus, the sealing state of the opening rim 108 is maintained with the cap 103, and the airtightness of the container body 102 can be improved.

Thus, the container 101 with the cap of the second embodiment can prevent the cap 103 rising from the container body 102, due to rise of the internal pressure due to volatile contents stored in the container body 102 and actions to pull up the container 101 with the cap forcedly by holding only the cap 103, and thus the airtightness inside the container body 102 can be appropriately maintained all the time.

Here, a demonstration test regarding the effect of the container 101 with the cap of the second embodiment was performed. In the test method, three kinds of containers with different structures were prepared; a container 101 with a cap of the second embodiment, a container that has been removed of just the brim piece 117 from the embodiment (comparative example 1), and a container that has been further removed of the fitting pieces 116 of the elastic ring body 104 from comparative example 1 (comparative example 2). Note that, in comparative example 1, although the structure is different, an engaging section and a fitting section are provided, and the comparative example 1 can be said to be substantially the same as the container 1 with the cap in the first embodiment. Comparative example 2 corresponds to a conventional container with a cap. 30 ml of water was put inside each of the containers, the caps were put on, the containers were placed in a pressurized chamber, and airtightness under pressure was compared.

The comparison results are shown in Table 1 below.

TABLE 1

| | Embodiment | Comparative Example 1 | Comparative Example 2 |
|---|---|---|---|
| n1 | −650 mmHg | −250 mmHg | −30 mmHg |
| n2 | −505 mmHg | −245 mmHg | −35 mmHg |
| n3 | −635 mmHg | −210 mmHg | −45 mmHg |

Table 1 shows a difference in the atmospheric pressure and the air pressure after decompression when a water leakage has occurred in a decompression process, in the three samples of n1 to n3 of each container in the Embodiment, the Comparative Example 1, and the Comparative Example 2. In the Comparative Example 2 all the containers leaked water when decompressed to equal to or more than 45 mmHg, and in the Comparative Example 1 all the containers leaked water when decompressed to equal to or more than 250 mmHg. On the other hand, there was no water leakage in the container in the Embodiment even when decompressed to 500 mmHg or more. In this way, the Comparative Example 1 that has a fitting piece 116 on the elastic ring body 104 is clearly superior in airtightness compared to the comparative example 2 in which capping is performed with only the engaging section, but the container of the embodiment added with the brim piece 117 thereon is demonstrated to be a container that has a further improved airtightness than the comparative example 1.

Modified Example

Figure 17:
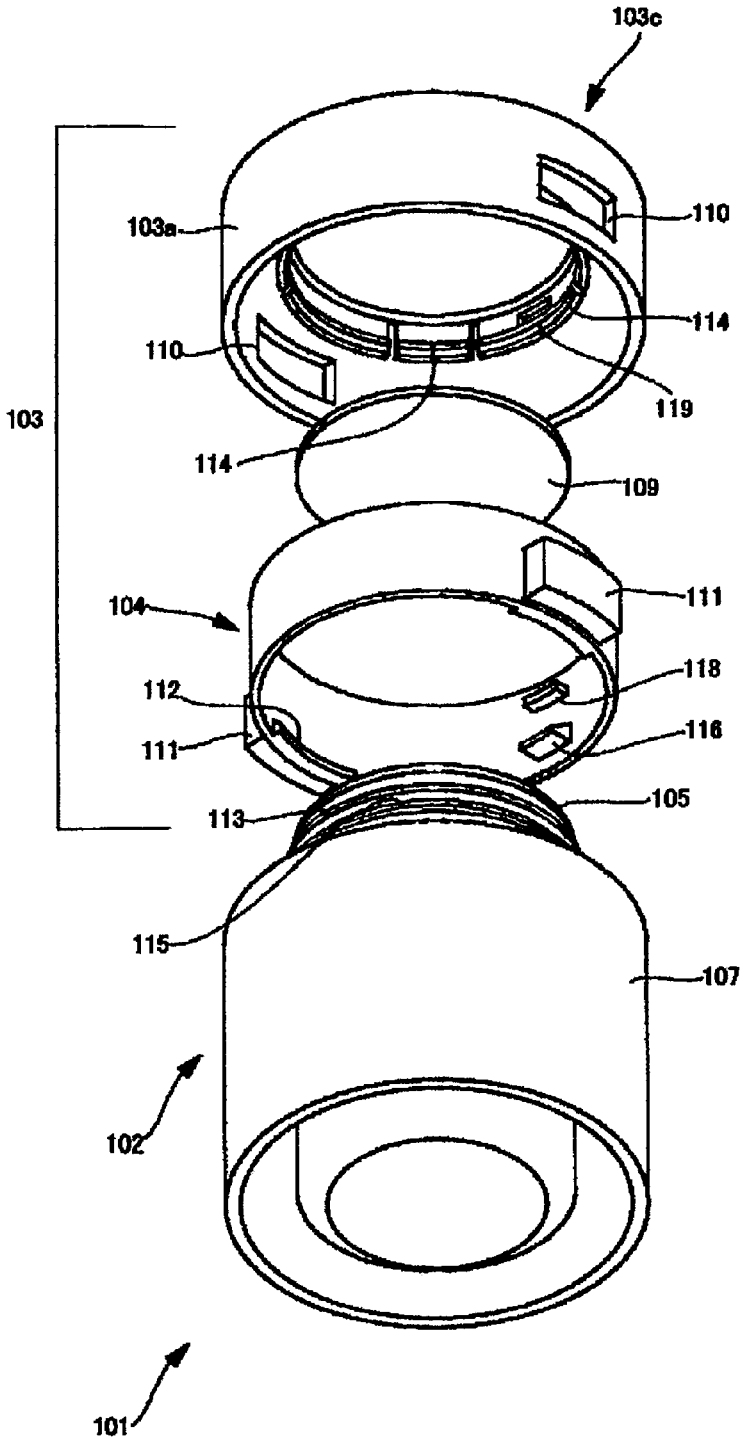
FIG. 17 is an exploded perspective view seen from below of the container in a modified example of the container in the second embodiment.
Figure 18A:
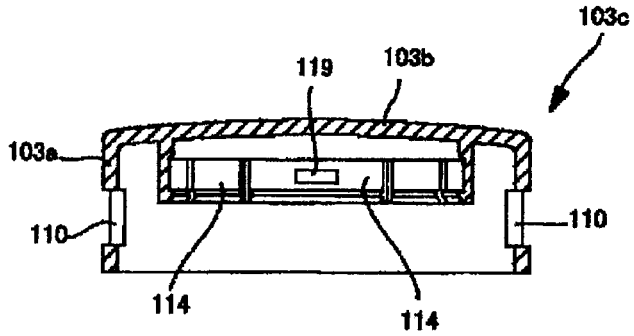
FIGS. 18A and 18B are explanatory views to explain the cap body and the elastic ring body structuring the cap of the container shown in FIG. 17.
Figure 18B:
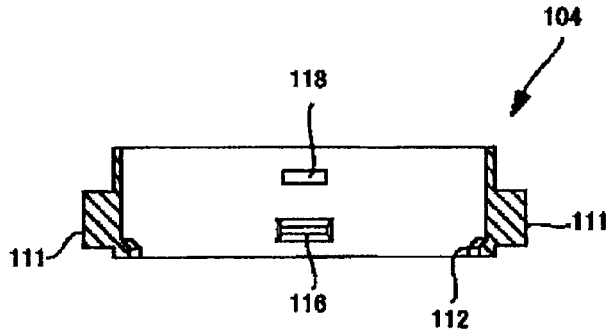

FIGS. 17 to 21 show the modified example of the container 101 with the cap of the second embodiment. Note that, in these figures, the same reference numerals as FIGS. 12 to 16 were used, excluding characteristic sections and structures of the modified example. FIGS. 17, 18A, and 18B are exploded views of the container 101 with the cap of the modified example of the second embodiment. FIG. 17 is an exploded perspective view of the container 101 with the cap seen from below, FIG. 18A is a side sectional view of the cap body 103*c*, and FIG. 18B is a side sectional view of the elastic ring body 104. The above described second embodiment is a structure in which the brim piece 117 structuring the engaging supporting section is formed in the cap body 103*c*, but in the modified example, the brim piece 118 is provided to the elastic ring body 104. Specifically, on the inner peripheral surface of the elastic ring body 114 is formed the brim piece 118 above the fitting piece 116. The engaging piece 114 formed hanging from the top section 103*b*, of the cap body 103*b*, is formed with an engaging hole 119 through which the brim piece 118 is inserted through.

Figure 19:
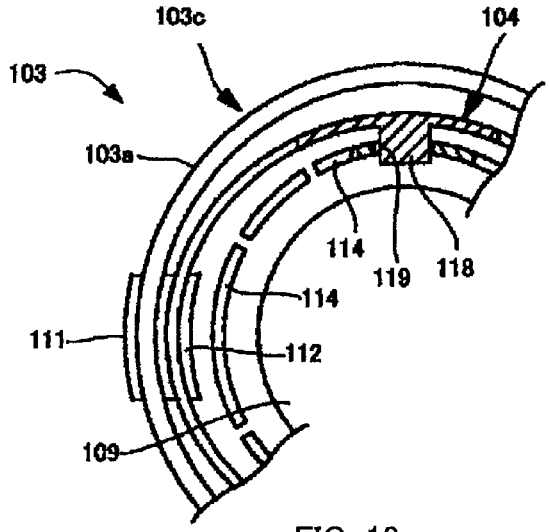
FIG. 19 is a partially cutaway view of the cap of the container shown in FIG. 17.

FIG. 19 shows a partially fragmented plan view of the cap 103 seen from below. The assembling sequence of the cap 103 is described with the FIG. 19. The brim piece 118 of the elastic ring body 104 and the engaging hole 119 of the engaging piece 114 of the cap body 103*c* are matched in position, and the elastic ring body 104 is elastically deformed and pushed inwards of the cylindrical peripheral wall 103*a* of the cap body 103*c*. When the push buttons 111 pass through the through holes 110, and the elastic ring body 104 is elastically restored, the brim piece 118 enters in the engaging hole 119, and the engaging supporting section is completed. Of course, the cap 103 can be assembled by inserting the push buttons 111 first into the through holes 110, and then engaging the brim piece 118 to the engaging hole 119.

Figure 20:
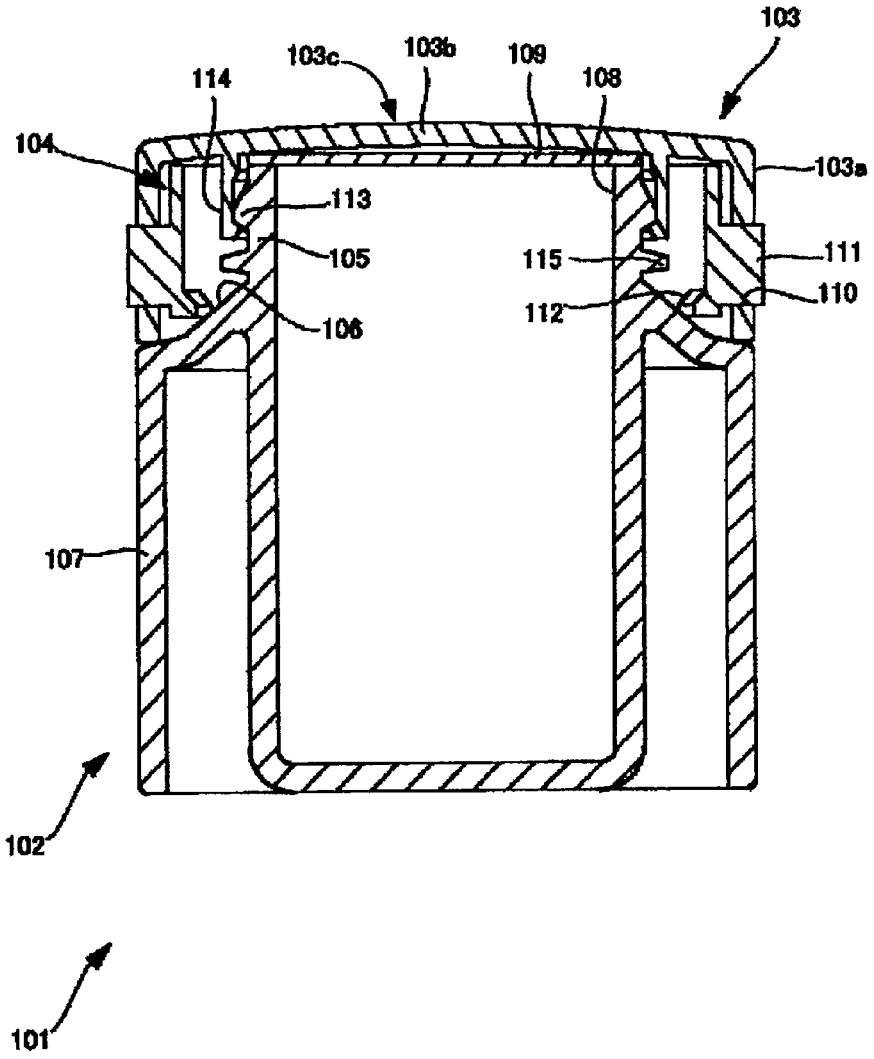
FIG. 20 is a front sectional view of the container shown in FIG. 17.
Figure 21:
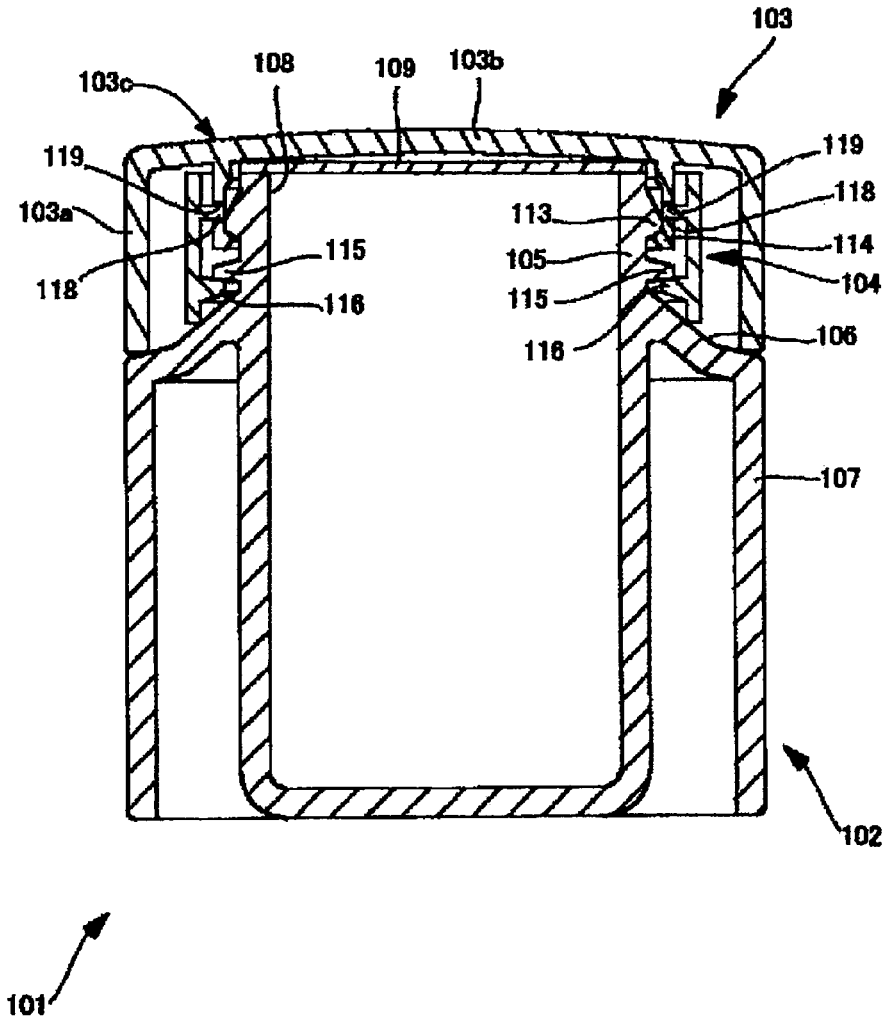
FIG. 21 is a side sectional view of the container shown in FIG. 17.

FIGS. 20 and 21 show the figures in which the cap 103 is fitted to the container body. FIG. 20, similar to the A-A line arrow view in FIG. 12, is a side sectional view when seen from an orthogonal direction to the protruding direction of the push buttons 111, and FIG. 21, similar to the B-B line arrow section in FIG. 12, is a side sectional view when seen from the protruding direction. The engaging supporting section is structured with the brim piece 118 inserted through the engaging hole 119. Namely, the elastic ring body 104 is engaged to the cap body 103*c*. In this modified example, the action of fitting the cap 103 to the container body 104, the engaging movement of the engaging section and the fitting movement of the fitting section accompanying the above, and the action of taking off the cap 103 from the container body 102, the actions of the engagement release of the engaging section and the fitting release of the fitting section accompanying the above, and the function of the engaging supporting section are similar, and the effects are similar to the above described second embodiment. Further, in the modified example, by the brim piece 118 moving in the engaging hole 119, an equivalent effect that the elastic ring body 104 smoothly elastically deforms is also realized.

Note that, in this modified example, the brim piece 118 is preferably formed around position of the fitting piece 116 and in the periphery thereof. Thus, without being affected by the deformation of the elastic ring body 104 that is elastically deformable, the reaction is taken directly by the fitting section, and the cap 103 can always be intimately contacted to the opening rim 108 of the container body 102. Further, the position of forming the brim piece 118 and the engaging hole 119 may be set in desired positions, as long as the elastic deformation of the elastic ring body 104 when assembling the push buttons 111 in the through holes 110 of the cap body 103*c* does not impair the engagement of the brim piece 118 to the engaging hole 119.

Further, as a similar example of the modified example, a structure can be considered in which the brim piece 118 is formed on the elastic ring body 104, the locking hole 119 is not formed on the engaging piece 114 of the cap body 103*c*, and as an opposite structure, the locking hole 119 is formed on the elastic ring body 104, and the brim piece 118 is formed on the engaging piece 114. The brim piece 117 in the second embodiment and the brim piece 118 in the modified example can each be formed to both the cap body 103*c* and the elastic ring body 104.

Third Embodiment

A container with a cap in a third embodiment of this invention also has a structure with further increased airtightness than the container 1 with the cap in the first embodiment similar to the container 101 with the cap in the second embodiment. But, the container with the cap in the third embodiment has a different cap structure from those of the first and second embodiment, and the elastic ring body is formed or attached to the top section of the cap. Hereinbelow, the specific structure and operation of the container with the cap of the third embodiment is described.

<Structure>

Figure 22:
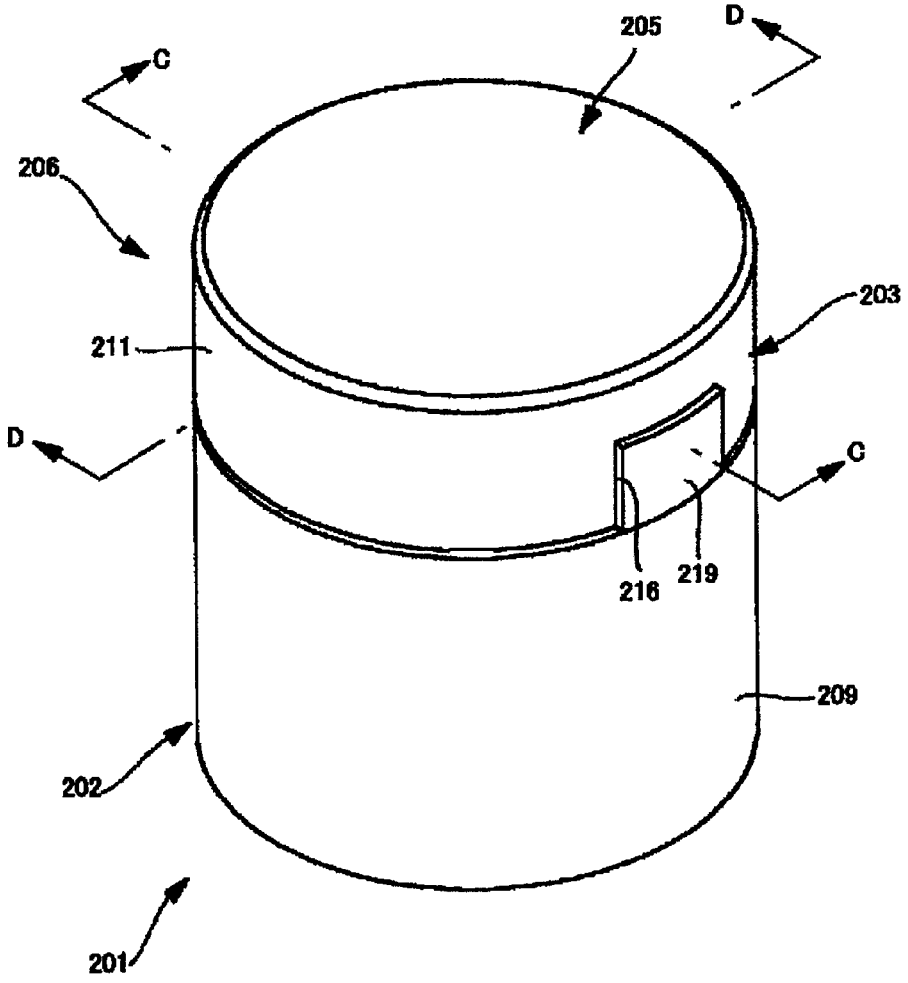
FIG. 22 is an overall perspective view showing a preferred embodiment of a container of a third embodiment of this invention.

FIG. 22 is an overall perspective view of the container 201 with the cap of the third embodiment. The container 201 with the cap of the third embodiment is similar in appearance to the above described containers (1, 101) with the cap in the first and second embodiments. A cap 206 that can be detached and attached to the top of the container body, with the container 201 in the upright state, is fitted. Further, the push button 219 provided in an internal structure of the cap 206 is exposed from the cylindrical peripheral wall 203*a*.

Figure 23:
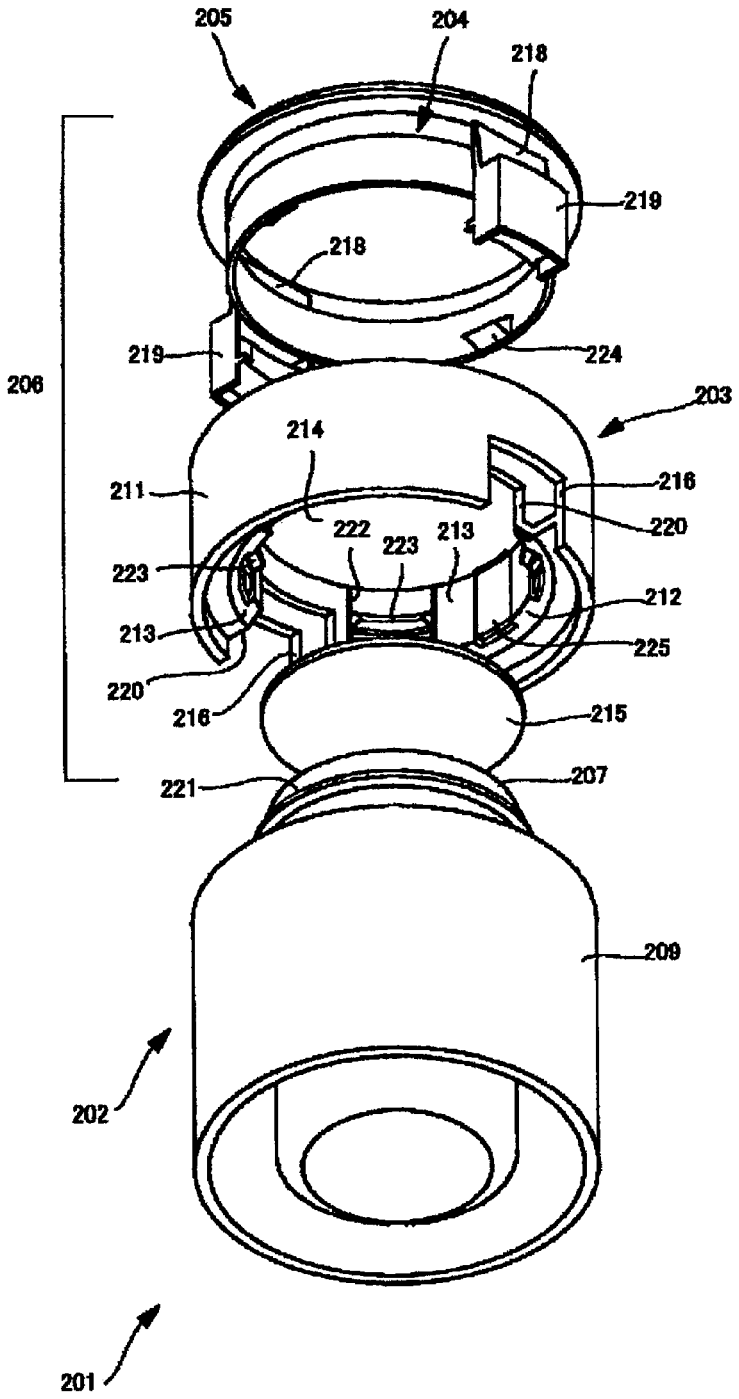
FIG. 23 is an exploded perspective view of the container shown in FIG. 22 seen from below.
Figure 24A:
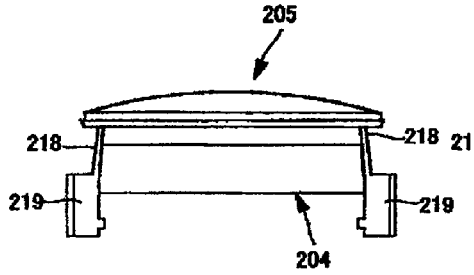
FIGS. 24A to 24E are explanatory views explaining the cap top section, cylindrical peripheral wall, and container body structuring the container shown in FIG. 22.
Figure 24B:
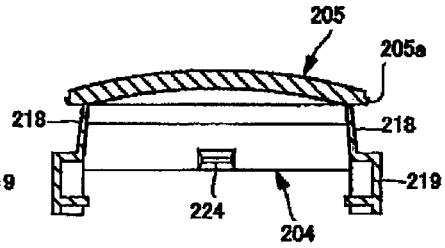
Figure 24C:
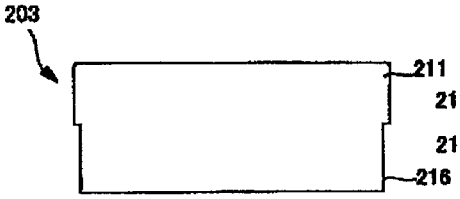
Figure 24D:
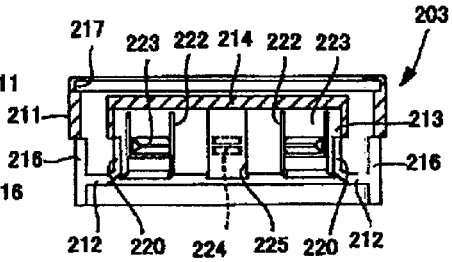
Figure 24E:
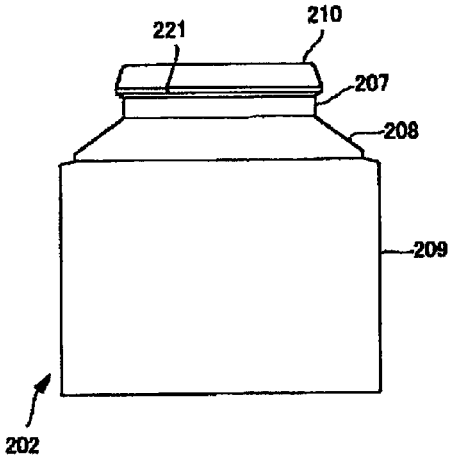

FIG. 23 and FIGS. 24A to 24E are diagrams showing the container 201 with the cap that has been disassembled into each component. FIG. 23 shows an exploded perspective view. As shown in FIG. 23, in the container 201 with the cap of the third embodiment, a top section 205 and a cylindrical peripheral wall 203 in the cap section 206 are structured from different components. Further, an elastic ring body 204 is attached to the top section 205. FIGS. 24A to 24E show separately the structure of each component structuring the container 201 with the cap. FIGS. 24A to 24E show, in this order, a side view of the top section 205 of the cap 206, a side sectional view of the top section 205, a side view of the cylindrical peripheral wall 203 of the cap 206, a side sectional view of the cylindrical peripheral wall 203, and a side view of the container body 202.

The container body 202 with a synthetic resin, metal, or glass as a raw material has a similar structure as those in the first and second embodiments. Namely, the container body 202 in a jar form or a hollow state has an opening rim 210 in an upper end, and from the top to the bottom in order, is continued with a small diameter neck section 207, a cone section 208, and a large diameter body section 209. The cone section 208 is formed along the entire periphery in the circumferential direction of the container body 202, as similar to the first and second embodiments, and is a ring shaped slope that is inclined outwardly to the lower side. Further, the neck section 207 is formed around with an annular protrusion 221, and this protrusion corresponds to the first ring shaped protrusion 9 in the first embodiment and also the second ring protrusion 10. Alternatively, this protrusion is an engaging protrusion 112 and a fitting protrusion 115 in the second embodiment.

The cylindrical peripheral wall 203 that structures the cap 206 has a double cylindrical structure structured from a hollow cylindrical outer tube body 211 and an inner tube body 213 surrounded by the outer tube body 211, and the outer tube body 211 and the inner tube body 213 are coupled via the support section 212 at the lower side. In the state in which the cap 206 is fitted to the container body 202, the inner tube body 213 surrounds the neck section 207 of the container body 202. The top section of the inner tube body 213 is closed by a top plate 214. When fitted, the lower surface of the top plate 214 faces the opening rim 210 of the container body 202. The lower surface of the top plate 214 is provided with a packing 215 that is plate shaped or that matches the diameter of the opening rim 210 and that closely contacts the opening rim 210. With this, when the cap 206 is fitted to the container body 202, the top plate 214 presses the packing 215 downwardly, and seals the opening rim 210.

Further, the inner tube body 213 is formed with two slits 222, which are a pair, extending in the vertical direction, and the wall surface of the inner tube body 213 can flexibly deform in the section sandwiched by these slits. The lower end of the wall section that can elastically deform is formed with a protrusion protruding in a hook shape toward the inner side, and with the flexible wall section and the hook shaped protrusion, the engaging piece 223 that engages with the annular protrusion 221 of the container body 202 is structured. Further, the engaging section is structured with the annular protrusion 221 and the engaging piece 223. On the other hand, a part of the lower end surface of the outer tube body 211 is cut out facing each other in the diametral direction. Then, the push buttons 219 of the elastic ring body 201 are exposed to the outside of the cap 206 via these notched sections 216. Further, the inner surface near the upper end of the outer tube section 211 is formed a peripheral groove 217. Note that, in the wall surface of the inner tube body 213, in positions corresponding to the notched sections 216 are formed escape holes 220 to expose the push buttons 219 from the inner side of the inner tube body 213 to the outside of the outer tube body 211.

Below the top section 205 is arranged the elastic ring body 204 that is integrally formed with the push buttons 219 on the peripheral surface. In the third embodiment, a pair of flexible pieces 218 are formed hanging from the lower surface of the top section 205, and below the flexible pieces 218 are integrally formed the push buttons 219. Therefore, the elastic ring body 204 is attached to the top section 205 in a state hanging downwardly from the top section 205 via the flexible pieces 218. The positions in which the push buttons 219 are formed match the pair of notched sections 216 of the outer tube body 211, in the assembled state cap 206. Further, in positions orthogonal with the position the push buttons 219 are formed on the inner peripheral surface of the elastic ring body, is formed a fitting piece 224 that protrudes inwardly.

Figure 25:
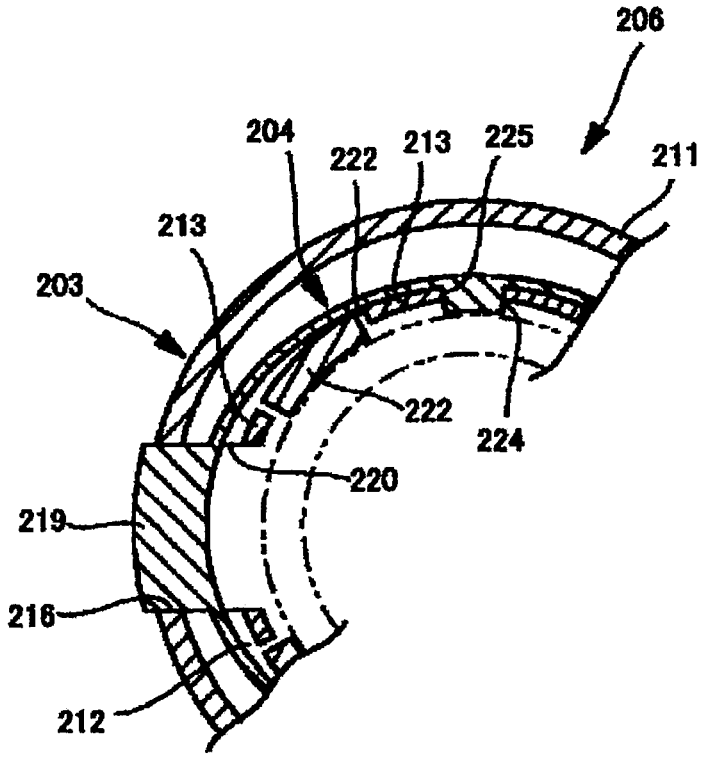
FIG. 25 is a partially cutaway bottom view of the cap of the container shown in FIG. 22.

FIG. 25 shows a partially fragmented plan view of the cap 206 seen from below. The arrangement relationship of each component structuring the cap 206 and the assembling sequence of the cap 206 are described according to FIG. 25. Schematically, the peripheral edge 205*a* of the top section 205 is formed in a shape to fit the above described peripheral groove 217 of the outer tube body 211, and when the peripheral edge 205*a* is fitted to the peripheral groove 217, the top section 205 is integrally assembled with the cylindrical peripheral wall 203 so as to cover the top plate 214. The elastic ring body 204 integrally formed with the top section 205 is positioned in between the container body 202 and the outer tube body 211 sandwiching the inner tube body 213. The push buttons 219 are inserted through the escape holes 220 formed in the inner tube body 213, when assembling the top section 205 to the cylindrical peripheral wall 203, and thus the push buttons are exposed to the outside of the cap 206 via the notched sections 216.

The assembling sequence of the cap 206 and the arrangement relationship of each component are described more specifically. First, the top section 205 is pressed in from above the cylindrical peripheral wall 203, and the peripheral edge 205*a* of the top section 205 is fitted to the peripheral groove 217 of the outer tube body 211. Therefore, the top section 205 is integrally assembled to the cylindrical peripheral wall 203. In this pressing operation, the elastic ring body 204 of the top section 205 is positioned in between the outer tube body 211 and the inner tube body 213 of the cylindrical peripheral wall 203, and the push buttons 219 are fitted in the notched sections 216 via the escape holes 220 formed in the inner tube body 213.

Further, on the wall surface of the inner tube body 213 of the cylindrical peripheral wall 203 is formed a window hole 225 to expose the fitting piece 224 formed on the inner surface of the elastic ring body 204 from the outside of the inner tube body 213 to inwards of the inner tube body 213. In the above pushing operation, the fitting piece 224 is matched to a position in which the window hole 225 of the inner tube body 213 is formed to integrate the top section 205 and the cylindrical peripheral wall 203. The fitting piece 224 is provided matching the position of the window hole 225 formed in the inner tube body 213 avoiding the positions of the push buttons 219 and the engaging pieces 223. Thus, on the inside and outside of the cap 206, the push buttons 219, the engaging pieces 223, and the fitting piece 224 is appropriately arranged, in the circumferential direction, and the lower end section of the elastic ring body 204 is supported from below in a state always contacting the support section 212 connecting the outer tube body 211 and the inner tube body 213 of the cylindrical peripheral wall 203.

<Attaching and Detaching of the Cap>

Figure 26:
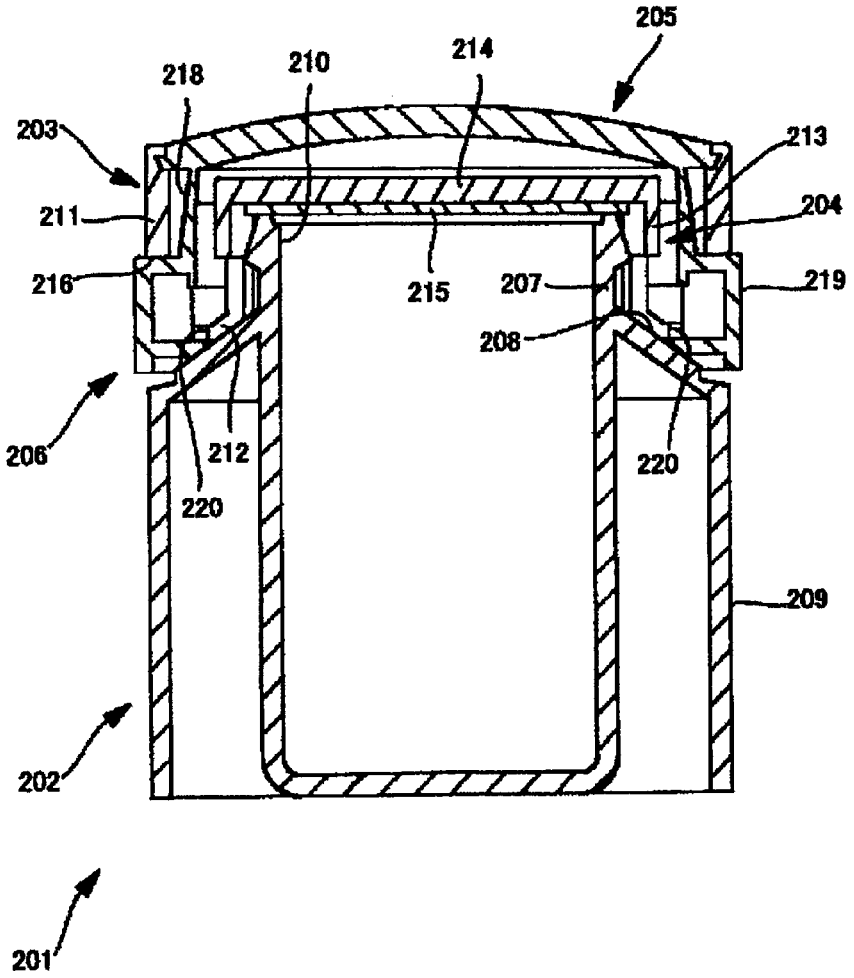
FIG. 26 is a cross-sectional view on arrow C-C in FIG. 22.
Figure 27:
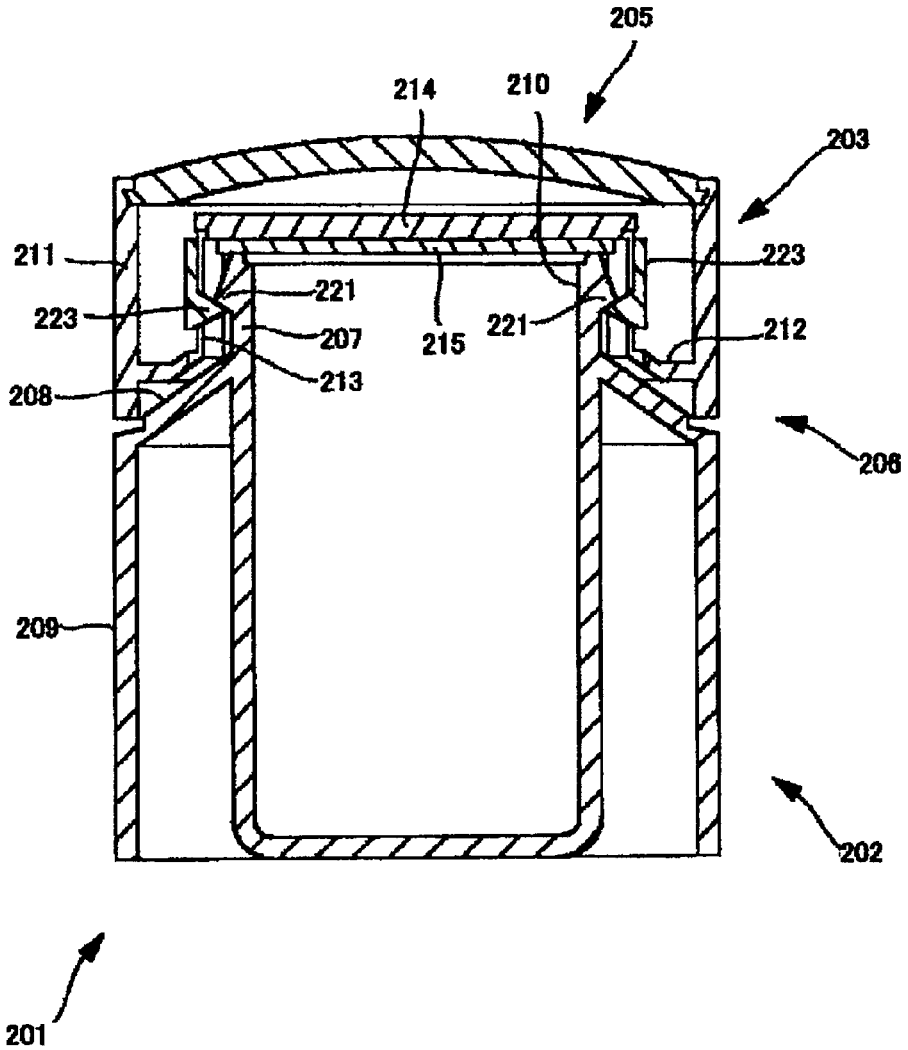
FIG. 27 is a cross-sectional view on arrow D-D in FIG. 22.

Next, the detaching and attaching structures of the cap 206 and the container body 202 and the actions when detaching and attaching the above are described. FIG. 26 shows a C-C line arrow sectional view of FIG. 22, and FIG. 27 shows a D-D line arrow sectional view of FIG. 22. When the cap 206 is pressed from above the container body 202, the engaging pieces 223 elastically deform and go over the annular protrusion 221 and engage at the lower side, and the cap 206 is held horizontally in respect to the container body 202. Further, the fitting piece 224 protrudes inwardly of the inner tube body 213 via the window hole 225 formed in the inner tube body 213, and this fitting piece comes in contact with the annular protrusion 221 and elastically deforms the elastic ring body 204. Then, the fitting piece 224 goes over the annular protrusion 221 and fits to the lower side of the annular protrusion 221. Then, the packing 215 of the cap 206 closely contacts the opening rim 210 of the neck section 207, and the airtightness inside the container body 202 is maintained.

Thus, in the third embodiment, the engaging pieces 223 and the fitting piece 224 engage and fit to the single annular protrusion 221 in different places, and the cap 206 is held on the neck section 207 of the container body 202. Then, in the state that the cap 206 is fitted on the container body 202, the lower ends of the push buttons 219 formed on the elastic ring body 204 come in contact on the cone section 208.

When taking off the cap 206, the push buttons 219 are pressed, the cap 206 is made to rise, and the engagement with the engaging section and the fitting with the fitting section are released. The rising action of the cap 206 with the pressing operation of the push buttons 219 is basically the same as in the first and second embodiments. Namely, when the elastic ring body 204 is elastically deformed, with this elastic deformation, the elastic ring body 204 with the push buttons 219 gradually moves up along the cone section 208 from below to above. Thus, the cap 206 assembled with the elastic ring body 204 and the push buttons 219 via the top section 205 gradually rises upward.

When the cap 206 is urged in an upward direction, the engaging pieces 223 are separated from the annular protrusion 221 and the engagement is released. Further, when the elastic ring body 204 is elastically deformed, the fitting section 224 moves in the radial direction outward of the neck section 207 and separates from the annular protrusion 221, and the fitting state is also released. Namely, both the cylindrical peripheral wall 203 and the elastic ring body 204 are separated from the container body 202, and the cap 206 comes off the container body 2 via the rise of the cap 206 accompanying the deformation of the elastic ring body 204.

Note that, the fitting strength of the fitting section and the engaging strength of the engaging section are similar to that in the first and second embodiments. Namely, the fitting section separates not from the elastic effect of the fitting piece 224, but from the elastic deformation effect of the elastic ring body 204, and the engaging section separates from the elastic deformation effect of the engaging pieces 223 that are elastically deformable. The release strength of the fitting section is made larger than that of the fitting section in respect to the rise of the cap 206. The release strength of the engaging section should be a strength in which when the elastic ring body 204 is pressed the cap 206 easily rises and smoothly separates. If the release strength is too weak, however, the fitting between the cap 206 and the container body 202 will depend only on the fitting piece 224 formed on the push buttons 219.

Further, the number of the fitting piece 224 is preferably two sections that are orthogonal to the push buttons 219, but when the engagement is released, the cap 206 inclines in respect to the container body 202, and there is a possibility that the airtightness will not be able to be maintained stably even if the cap does not easily separate. Therefore, in addition to an accidental separation, in order to seal the container body 202 with reliability, adjustment of the release strength is necessary. The release strength of this fitting section is preferably, schematically, such that even if only the cap 206 is pulled upwards without pressing the push buttons 219 the engagement is not released, and when the push buttons 219 are pressed and the elastic ring body 204 is deformed the cap can be easily separated. A specific numerical value of the release strength is preferably similar to that in the second embodiment. Further, these strength adjustments are performed by adjusting an applying amount or an angle of contact and inclination of the engaging piece 223 and the annular protrusion 221, or the fitting piece 224 and the annular protrusion 221. In order to more clearly differentiate the release strength of the engaging section and the fitting section, similarly to the first and second embodiments, two annular protrusions 221 are separately formed on the container body 202, and the length and inclination angle of each protrusion can be changed.

<Function of Supporting Section>

In the third embodiment, the detaching and attaching action of the cap with the engaging section and the fitting section similar to those in the first embodiment is realized, and is also provided with the support sections 212 that serve the similar function as the brim piece 117 in the second embodiment. In the third embodiment, the coupling section of the outer tube body 211 and the inner tube body 213 of the cylindrical peripheral wall 203 is made as the support section 212, and the lower end surface of the elastic ring body 204 contacts the upper surface of the support section 212, to support the elastic ring body 204 from below. The function of this support section 212 is described below.

In the case that the support sections 212 are not appropriately contacting the elastic ring body 204, namely, when there is no support section 212, when a force to try to take off the cap 106 without pressing the push buttons 219 is added, when such force is transferred to the elastic ring body 204, from the cylindrical peripheral wall 203 via two flexible pieces 218 formed on the top section 205, since two fitting pieces 224 maintaining fitting with the container body 202 are formed in positions orthogonal to the flexible pieces 218 on the elastic ring body 204, the elastic ring body 204 bends in the vertical direction. At this time, fitting section maintains the fitting state, but only the engaging section with the weak release strength slightly separates. Therefore, the airtightness inside the container body 202 decreases. But if the support section 212 contacts the elastic ring body 204 and supports the elastic ring body 204 from below, even if a force is added to try to separate the cap 206 from the container body 202 without pressing the push buttons 219, such a force is not transferred from the cylindrical peripheral wall 203 to the flexible pieces 218, and is transferred to the entire elastic ring body 204 through the support sections 212. Therefore, the elastic ring body 204 does not bend, and the airtightness inside the container body 2 can be maintained high.

<Effects>

The container 201 with the cap of the third embodiment can prevent the cap 206 from rising up from the container body 102, as similar to the container 102 with the cap of the second embodiment, with an internal pressure rise due to a volatile content stored in the container body 202, and an action of raising the container 201 with the cap by holding just the cap 206. Therefore, the airtightness inside the container body 202 can always be appropriately maintained. Further, the container 201 with the cap of the third embodiment can complete the cap 206 by just assembling the top section 205 from above the cylindrical peripheral wall 203, so that it can be easily assembled, and productivity can be increased.

Further, with the container 1 with the cap of the first embodiment, it was necessary to assemble the elastic ring body 4 and the cap by passing the push buttons 13 through the through holes 12 provided in the cylindrical peripheral wall 3*a*, and to expose the push buttons 13, to the outside of the cylindrical peripheral wall 3*a*, to a height for the stroke amount to at least elastically deform the elastic ring body 4. But in the third embodiment, the elastic ring body 204 is attached to the top section 205 via the flexible pieces 218, and is also supported by the support sections 212 from below, thus the periphery of the push buttons 219 can be made into a free shape where fingers can easily press down, by forming in notched shapes or by forming escapes. Note that, of course, the container 201 with the cap of the third embodiment serves a similar effect as the container 1 with the cap of the first embodiment.

Modified Example

Figure 28:
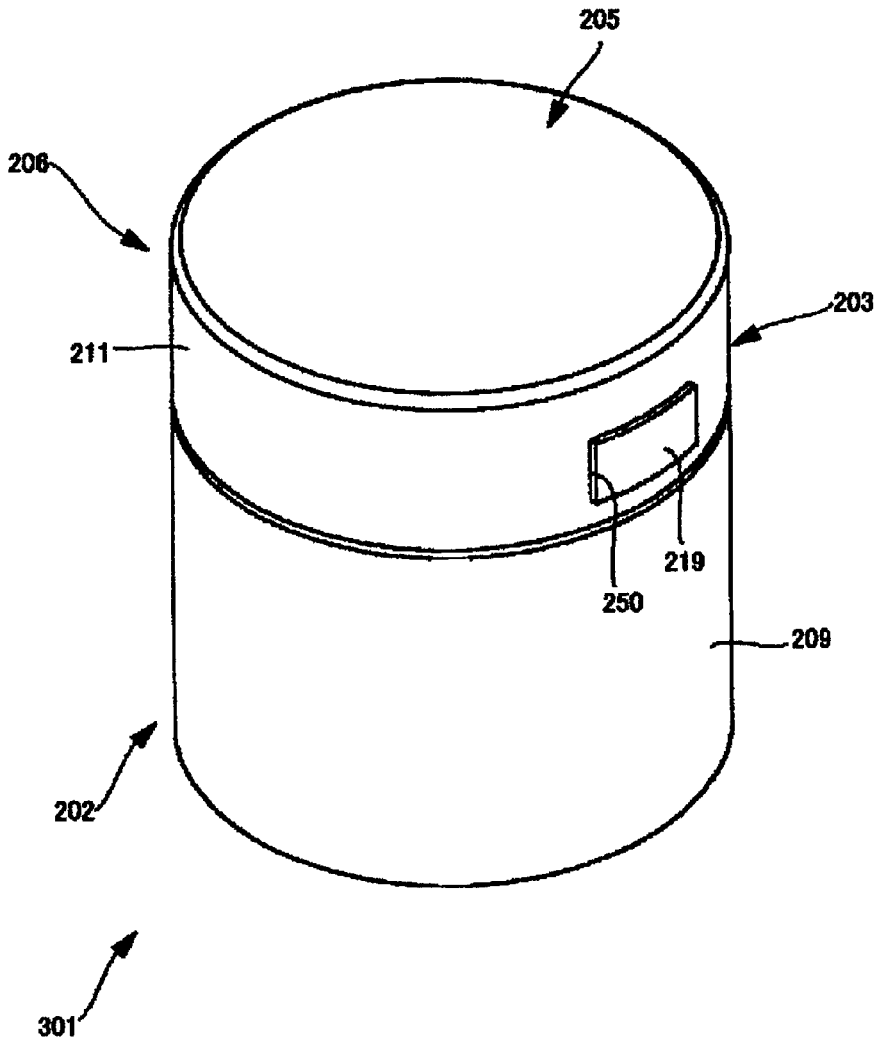
FIG. 28 is an overall perspective view showing a modified example of the container with the cap in the third embodiment of the present invention.

The modified example can replace the notched sections 216 with through holes as similar to the first and second embodiments. FIG. 28 shows a container 301 with the cap with through holes 250 as a modified example of the third embodiment. In the figure, the parts with no large change in structure or shape are given the same reference numbers as in the container 201 with the cap of the third embodiment. As shown in FIG. 28, through holes 250 that are facing each other are formed in the outer tube body 211. Note that, in this case, the pair of flexible pieces 218 formed on the top section 205 are formed matching the positions of the through holes 250 of the outer tube body 211.

Note that, in the case that notches 216 replace the through holes 250, for example, in the case that the size of the push buttons 219 are smaller than the fingers pressing them, the push buttons 119 cannot be further pushed in at the time the push buttons 119 become flush with the outer wall surface of the outer tube body 211. On the other hand, in the case a part of the outer tube body 211 is deficient as the notched sections 16, the push buttons 219 can be further pressed inwards than the wall surface of the outer tube body 11, and the pressing operation can be improved and the moving range of the elastic ring body 204 can be expanded, so that it is preferable to have the notched sections 216 in the case the size of the push buttons 219 are small.

The elastic ring body 204 does not necessarily have to be integrally formed with the top section 205. In the case that there are no flexible pieces 218, and the top section 205 and the elastic ring body 204 are separate parts, first the elastic ring body 204 is placed in between the outer tube body 211 and the inner tube body 213 of the cylindrical peripheral wall 203, and then the top section 205 may be fitted to the peripheral groove 217 formed to the upper end of the outer tube body 211. The top section 205 and the cylindrical peripheral wall 203 can be integrated by adhesive or ultrasonic welding and the like, without using the peripheral groove 217.

Namely, the cap 206 is structured from two components of a first component including the tubular tube section 203 with the support section 212, and a second component including the top section 205 having the elastic ring body 204. There is a case in which these two components are integrally assembled so that the lower end section of the elastic ring body 204 is positioned on the support section 212, and there is a case in which the cap is structured from three components of the cylindrical peripheral wall 203 having the support section 212, the elastic ring body 204, and the top section 205, and the elastic ring body 204 is integrally assembled in the cap 206, in a state contacting the support section 212 of the cylindrical peripheral wall 203.

Other Embodiments

In the above embodiments, the container bodies (2, 102, 202) and the caps (3, 103, 206) are circular in a horizontal sectional shape, but of course they may be an oval shape of a polygonal shape. The elastic ring bodies (4, 104, 204) are also deformable in various ways so as to be restorable, and may be elastically deformable in a diametral direction almost orthogonal to the pressing direction when pressed from any radial direction, and the horizontal sectional shape is not limited to the circular shape and may be a polygonal or oval shape.

Further, the positions in which the ring shaped protruding sections (9, 10) in the first embodiment and the engaging protrusion 113 and the fitting protrusion 115 in the second embodiment are formed on the container bodies (2, 102) may be reversed vertically. For example, the first ring shaped protruding section 9 can be formed below the second ring shaped protruding section 10.

Further, in the first and second embodiments, the protrusions were formed around the container bodies (2, 102) in two levels one above the other, such as the first ring shaped protruding section 9 and the second ring shaped protruding section 10, and the engaging protrusion 113 and the fitting protrusion 115, but similar to the third embodiment, just one of these two protrusions can be used. For example, in the second embodiment, the fitting protrusion 115 forming the fitting section and the engaging protrusion 113 forming the engaging section can be formed as an integral protrusion, and this one protrusion can be structured to be fitted with the fitting piece 116 of the elastic ring body 104, or to be engaged with the engaging piece 114 of the cap body 103*c*.

In the above described embodiments, the cone section (6, 106, 208) was formed around the entire periphery in the circumferential direction of the container body (2, 102, 202), but they may be partially formed. Further, the cone section (6, 106, 208) was formed around the opening rim (8, 108, 210) of the container body (2, 102, 202), but a tube body surface corresponding to the neck section in which the protrusion structuring the engaging section and the fitting section, namely, the ring shaped protruding section (9, 10, 17), the engaging protrusion 113, the fitting protrusion 115, the annular protrusion 221, may be formed below the cone section (6, 106, 208). The cone section (6, 106, 208) may be formed to places only to face the inner side of the push buttons (13, 111, 219) of the elastic ring body (4, 104, 204). The cone surface of the cone section may be formed to only the push buttons (13, 111, 219), and the container body can be formed with corners that contact the cone surface to structure the gradually moving means.

REFERENCE SIGNS LIST

1, 101, 201, 301 container with cap
2, 102, 202 container body
3, 103, 206 cap
3*a*, 103*a*, 203 cylindrical peripheral wall
3*b*, 103*b*, 205 top section
3*c*, 103*c* cap body
4, 104, 204 elastic ring body
6, 106, 208 cone section
8, 108, 210 opening rim
9 first ring shaped protruding section
10 second ring shaped protruding section
12, 110, 250 through hole
13, 111, 219 push buttons
14 second engaging section
15 flexible wall section
16 first engaging section
17 single ring shaped protruding section
113 engaging protrusion
114, 223 engaging piece
115 fitting protrusion
116, 224 fitting piece
117, 118 brim piece
212 support section
216 notched section
221 annular protrusion
L1 engaging length between second engaging section and second ring shaped protruding section
L2 engaging length between first engaging section and first ring shaped protruding section
θ1 engaging angle between second engaging section and second ring shaped protruding section
θ2 engaging angle between first engaging section and first ring shaped protruding section

The invention claimed is:

1. A container comprising a container body and a cap, the container body in an upright position having from the top to the bottom in order an upper opening, a neck section, a cone section and a body section, the cap being fitted in a detachable manner to the container body to seal the upper opening of the container body, wherein the cap comprises a top section, a peripheral side wall that hangs downward from a peripheral edge of the top section, an elastic ring body that is surrounded by the peripheral side wall and is elastically deformable in a radial direction, and push buttons that are formed on a peripheral surface of the elastic ring body to protrude in opposite directions to each other, wherein the cone section of the container body gradually expands from a lower end of the neck section to an upper end of the body section, and a lower inner edge of the elastic ring body comes to contact with the cone section when deformed in radial direction thereof, wherein the push buttons are formed to extend from the inside to the outside of the peripheral side wall of the cap, and when the push buttons are pressed in opposed directions, the elastic ring body is deformed to reduce the diameter thereof and the cap is moved up together with the elastic ring body, the container further comprising an engaging section and a fitting section, wherein the engaging section engages the cap with the container body in a state the cap is fitted to the container body, holds the cap and the container body in a predetermined positional relationship, and releases the engagement when the cap is made to rise from the fitted state, wherein the fitting section engages the elastic ring body to the container body, in a state the cap is fitted to the container body, and releases the engaged state when the elastic ring body is elastically deformed, wherein an engaging strength of the fitting section is set stronger than an engaging strength of the engaging section.

2. The container according to claim 1, wherein the body section of the container body is larger in diameter than the neck section, and the cone section is formed between the neck section and the body section to gradually expand toward the lower side from the neck section to the body section.

3. The container with a cap according to claim 1, wherein the cone section is formed on the elastic ring body, and a peripheral side surface of the container body is made to contact with the cone section when the elastic ring body is deformed.

4. The container according to claim 1, wherein the engaging section comprises a first protrusion provided on the peripheral side surface of the neck section of the container body, and an engaging piece provided inside of the peripheral side wall of the cap and arranged to be engaged with the first protrusion, and wherein the fitting section is composed of a second protrusion provided on the peripheral side surface of the neck section of the container body, and a fitting projection provided inside of the elastic ring body to be engaged with the second protrusion.

5. The container according to claim 4, wherein a length during which the fitting projection engages the second protrusion is set longer than a length during which the engaging piece engages with the first protrusion.

6. The container according to claim 4, wherein a fitting angle (θ1) between the fitting projection and the second protrusion is set smaller than an engaging angle (θ2) between the engaging piece and the first protrusion.

7. The container according to claim 4, wherein the engaging piece is formed in a hook-shape at a tip end of a flexible wall provided to the cap.

8. The container according to claim 4, wherein a plurality of the engaging piece is provided inside the peripheral side wall of the cap with a spacing in between in a circumferential direction of the peripheral side wall.

9. The container according to claim 4, wherein the engaging piece is provided along an entire periphery in the circumferential direction of the inner wall surface of the peripheral side wall of the cap.

10. The container according to claim 1, wherein the push buttons are exposed to the outside via through holes perforated in the peripheral side wall of the cap.

* * * * *